US006858082B2

(12) United States Patent
Sirejacob

(10) Patent No.: US 6,858,082 B2
(45) Date of Patent: Feb. 22, 2005

(54) DEVICE FOR COATING AN ELEMENT AND COATING PROCESS

(75) Inventor: Gino Sirejacob, Evergem (BE)

(73) Assignee: CF Technologies, Deinze (BE)

( * ) Notice: Subject to any disclaimer, the term of this patent is extended or adjusted under 35 U.S.C. 154(b) by 0 days.

(21) Appl. No.: 10/268,030

(22) Filed: Oct. 9, 2002

(65) Prior Publication Data

US 2003/0113467 A1 Jun. 19, 2003

Related U.S. Application Data

(60) Continuation-in-part of application No. 09/841,567, filed on Apr. 19, 2001, now abandoned, which is a division of application No. 09/395,389, filed on Sep. 13, 1999, now Pat. No. 6,248,170.

(51) Int. Cl.[7] ..... B05C 1/06

(52) U.S. Cl. ..... 118/264; 101/167; 101/425; 15/256.53

(58) Field of Search ..... 118/108, 109, 118/206, 207, 264, 304, 307, 321, 323; 427/425, 429; 101/167, 424, 425; 15/256.53

(56) References Cited

U.S. PATENT DOCUMENTS

| | | | | | |
|---|---|---|---|---|---|
| 3,952,654 | A | * | 4/1976 | Evans | 101/425 |
| 3,983,813 | A | * | 10/1976 | Tani | 101/425 |
| 4,128,326 | A | * | 12/1978 | Selak | 396/611 |
| 4,408,688 | A | * | 10/1983 | Bieri | 198/500 |
| 4,466,348 | A | | 8/1984 | Buhrer | 101/163 |
| 5,379,695 | A | | 1/1995 | Rieth et al. | 101/424 |
| 5,480,754 | A | | 1/1996 | Takei et al. | |
| 5,765,286 | A | | 6/1998 | Sato et al. | |
| 6,676,754 | B1 | * | 1/2004 | Fleming et al. | 118/325 |

FOREIGN PATENT DOCUMENTS

| | | | |
|---|---|---|---|
| EP | 0 451 844 | 10/1991 | G03G/5/05 |
| FR | 2 646 952 | 3/1989 | G11B/5/00 |
| GB | 2 287 904 | 10/1995 | G03G/21/00 |
| WO | WO-01/20421 A1 | 3/2001 | |

* cited by examiner

*Primary Examiner*—Laura Edwards
(74) *Attorney, Agent, or Firm*—Darby & Darby

(57) ABSTRACT

A device for coating an element is described. The device is capable of bearing and using a swab impregnated with a coating composition and includes a mobile carriage for bearing the swab. The carriage is movable along a guiding path. The device further includes an element for pushing the swab towards the element to be coated so that a quantity of the composition released from the swab coats an element. The device also includes an element for distributing the composition, so that the coating is substantially uniform.

48 Claims, 15 Drawing Sheets

DEVICE FOR COATING AN ELEMENT AND COATING PROCESS

The present application is a continuation in part of U.S. Ser. No. 09/841,567, filed on Apr. 19, 2001 now abandoned, and allowed on Aug. 12, 2002, which is a divisional of U.S. Ser. No. 09/395,389 filed on Sep. 13, 1999, now U.S. Pat. No. 6,248,170.

THE PRIOR ART

In the recycling technology of toner cartridges of copiers, facsimile machines and laser printers, it has been proposed to provide the photosensitive drum or the magnetic roller or primary charging roller with a coating. For these purposes, devices have been proposed for facilitating the coating step. The said devices use a swab impregnated with the coating composition (a liquid composition). In the known devices, the swab contact the drum or roller while driven in rotation, and the swab is moved horizontally and parallel to the axis of rotation of the drum or roller. Therefore, the amount of composition released from the swab when beginning the coating is higher than the amount of composition released from the swab at the end of the coating step.

Problems of such a coating are:

not uniform coating, risk of lack of coating composition for the last coated part of the drum or roller, whereby a part of the roller or drum to be coated can remain uncoated, due to a lack of composition in the swab.

The present invention has for subject matter a device whereby a substantially uniform coating can be obtained on elements such as drums, rollers, blades can be obtained.

BRIEF DESCRIPTIONS OF THE INVENTION

The invention relates to a device for coating at least a part of an element by means of a swab impregnated with a coating composition, said device comprising:

- a support provided with a guiding path and with a means for bearing the element to be coated
- a mobile carriage with means for bearing the swab, said carriage being movable along the guiding path;
- a means for ensuring a movement of the mobile carriage along the guiding path with respect to the element to be coated;
- a means for pushing the swab towards the element to be coated so that a quantity of the composition released from the swab coats the element, and
- a means for varying the quantity of released composition per unit of length of movement of the mobile carriage along at least a part of the guiding path, so that the coating of the said part is substantially uniform.

Advantageously, the device further comprises a room in which at least the support and the mobile carriage are located, said room being provided with an inlet connected to an air cleaning system. Preferably, the said inlet is adapted for ensuring a substantially laminar flow at least in the neighbourhood of the support and the mobile carriage. Such an air inlet is advantageous for preventing dust or other solid particles to enter into the applied and/or to be applied on the coating before its complete hardening or its tack free.

According to an embodiment, the device further comprises a table, a vertical supporting element, and fixing means, whereby the support is movable between a first position in which the support is fixed to the table and a second position in which the support is fixed on the vertical supporting element. Preferably, the vertical supporting element is mounted pivotable around a vertical axis.

Preferably, especially when the element to be coated is a drum or a roller, the device further comprises a driving means for driving into rotation the element to be coated.

A preferred device of the invention comprises:

- a support provided with a guiding path and with a means for bearing the element to be coated;
- a mobile carriage with means for bearing the swab, said carriage being movable along the guiding path;
- a means for ensuring a movement of the mobile carriage along the guiding path with respect to the element to be coated;
- a means for pushing the swab towards the element to be coated so that a quantity of the composition released from the swab coats the element, and
- a means for varying the quantity of released composition per unit of length of movement of the mobile carriage along at least a part of the guiding path, so that the coating of the said part is substantially uniform, whereby the said means for varying the quantity of released composition per unit of length of movement of the mobile carriage along at least a part of the guiding path is a means pushing of the swab towards the element to be coated during a movement of the mobile carriage along at least a part of the guiding path.

Advantageously, the means for varying the pushing of the swab towards the element to be coated varies the said pushing of the swab towards at least a part of the element during the movement of the carriage corresponding to the coating of the said part of the element by the swab, the said pushing varying substantially continuously from a first pushing force and a second pushing force so that the coating of the said part is substantially uniform. For example, in case of a vertical pushing of the swab towards the element to be coated, the said pushing varying substantially continuously from a first pushing force and a second pushing force higher than the first pushing force so that the coating of the said part is substantially uniform, while for a horizontal pushing of the swab towards the element, the said pushing varying substantially continuously from a first pushing force and a second pushing force lower than the first pushing force so that the coating of the said part is substantially uniform.

According to an advantageous embodiment, the mobile carriage has a body movable, along the guiding path, said body being provided with a pivoting piece bearing the swab. The pivoting piece is preferably pivoting around an axis with respect to the body, said axis being advantageously parallel to the axis of the guiding path.

According to an embodiment, the means for ensuring a movement of the mobile carriage along the guiding path with respect to the element to be coated moves the said mobile carriage according to a back-and-forth motion. At least during a part of the forth motion, the swab contacts the element to be coated. Preferably, the device further comprises a means for moving the swab and the element to be coated aside during the back motion of the carriage.

The device comprises advantageously a means for moving the swab and the element aside before the coating of the element and/or after the coating of the element, for example just after the end of the coating step. This is advantageous in order to ensure that during a first relative movement of the carriage, the swab is progressively moved towards the element, while at the end of the coating, during a relative movement of the carriage, the swab is progressively removed from the element. Thus the swab when in relative movement with respect to the element to be coated is moved from a position aside the element to a contact position with the element before starting the coating operation, and from a position in contact with the element to a position aside after ending the coating.

According to an advantageous embodiment, the device further comprises a means for holding the swab and the element aside when the carriage is adjacent to a first position of the guiding path, and a means for displacing at least a part of the carriage when the carriage is moved away from the said first position, so that the swab contacts the element. This movement of the swab is advantageously realized by a roller working with a nock.

According to a specific embodiment, the means for bearing the element to be coated comprises two bearing elements between which the element to be coated is placed, said bearing elements being aligned along a first axis, said axis being preferably the axis of rotation of the element to be coated. The mobile carriage is movable along an axis parallel to the guiding path of the carriage, said axis being distant from the said first axis and being not parallel to the said first axis. The second axis forms advantageously an angle with a line parallel to the said first axis and crossing the said second axis, said angle being preferably comprised between 0.1° and 15°, for example between 0.1° and 5°, especially between 0.2 and 2°.

The invention relates also to a process for coating an element with a coating composition, in which a swab impregnated with the coating composition is contacted with the element to be coated and is in relative longitudinal movement with respect to the element to be coated so as to release a quantity of composition for coating a part of the element, and in which the quantity of composition released by the swab per unit of length of relative movement of the swab with respect to the element is controlled so that the coating of the said part of the element with the composition is substantially uniform.

Advantageously, the swab contacts the element in an air clean environment, for example, an air clean environment containing substantially no particles with a size greater than 5 $\mu$m, preferably containing substantially no particles with a size greater than 1 $\mu$m. This is advantageous for preventing the presence of undesired large particles (dusts, etc.) in the coating or on the coating.

Preferably, the swab contacts the element in an air environment with a temperature comprised between 15 and 30° C. or with a controlled temperature and/or with a relative humidity of less than 50% (preferably of less than 40% or in a substantially dry air). Advantageously, the swab contacts the element in a substantially laminar clean airflow. The air environment can be controlled so as to adapt the temperature and/or the humidity and/or the speed of the air flow for obtaining the required coating, for example for controlling the evaporation of the solvent used in the composition, and/or for controlling the reaction speed and/or for ensuring a good application of the composition on the element to be coated.

Advantageously, the element is driven in rotation, and the swab contacts the element while rotating.

In the process of the invention, the swab is advantageously pressed with a controlled pressure on the element for obtaining an uniform coating. For example, the swab is pushed with a pushing force on the element to be coated, the said pushing force being controlled during the relative movement of the swab with respect to the element so as to obtain an uniform coating of the element.

When the swab is pushed with a vertical pushing force on the element to be coated, the said vertical pushing force is advantageously controlled during the relative movement of the swab with respect to the element so as that said vertical pushing force varies continuously from a first pushing force to a second pushing force, said second pushing force being greater than the first pushing force.

When the swab is pushed with a horizontal pushing force on the element to be coated and in which the said horizontal pushing force is controlled during the relative movement of the swab with respect to the element so as that said horizontal pushing force varies continuously from a first pushing force to a second pushing force, said second pushing force being lower than the first pushing force.

According to an advantageous embodiment of the process of the invention, the swab is moved with a back-and-forth motion with respect to the element to be coated, in which the swab contacts the element during at least a part of the forth motion, and in which the swab and the element are aside during the back motion of the swab.

Preferably, the coating composition is a composition for obtaining an antistatic and anti abrasive coating. Most preferably, the coating composition is a composition for obtaining an anti static, anti fog, anti stick, heat resistant, chemical resistant and anti abrasive coating.

The invention further relates to a process for recycling a toner cartridge comprising at least a magnetic roller and a doctor blade, in which the said doctor blade and magnetic roller are removed from the cartridge, in which the removed doctor blade and magnetic roller are coated with an antistatic and anti abrasive coating, and in which, after coating, the said doctor blade and magnetic roller are placed back in the cartridge. Before the coating operation, the doctor blade and magnetic roller are preferably cleaned. If required, the doctor blade is submitted to a treatment for substantially restoring the initial shape of the blade, for example by a heat treatment and by application of a pressure on the blade.

The invention relates also to:

- a process for recycling a toner cartridge comprising at least a magnetic roller, a doctor blade, a photosensitive drum, a wiper blade, a fuser roller and a primary charge roller, in which the photosensitive drum and the wiper blade are removed from the cartridge, in which the removed photosensitive drum and wiper blade are coated with an antistatic and anti abrasive coating, and in which, after coating, the said photosensitive drum and the wiper blade are placed back in the cartridge;
- a process for recycling a toner cartridge comprising at least a magnetic roller, a doctor blade, a photosensitive drum, a wiper blade, a fuser roller and a primary charge roller, in which at least three elements selected among the group consisting of magnetic roller, doctor blade, photosensitive drum, wiper blade; fuser roller and primary charge roller are removed from the cartridge, in which the said removed elements are coated with an anti abrasive coating, and in which, after coating, the said elements are placed back in the cartridge. The coating of the fuser roller is preferably an anti stick and anti abrasive roller, while the coating of the other elements of the toner cartridge to be coated is an anti static and anti abrasive coating.

The invention further relates to a device for coating at least a part of an element by means of a swab, said device comprising:

- a support provided with a guiding path and with a means for bearing the element to be coated,
- a mobile carriage with means for bearing the swab, said carriage being movable along the guiding path;
- a means for ensuring a movement of the mobile carriage along the guiding path with respect to the element to be coated, whereby ensuring a relative movement of the swab with respect to the element to be coated, a means for conducting a coating composition on the support to be coated, said means having an open end adjacent to the swab, and a means for pushing the swab towards the element to be coated so that the swab acts as means for distributing the coating composition flowing out of the open end, whereby the open end of the means for conducting a coating composition is mounted on a carrier movable along a guiding path with respect to the element to be coated, said open end being located with respect to the swab, so that the composition flowing out from the open end contacts first the element to be coated before being distributed by the swab, and whereby the means for conducting the coating composition comprises a volumetric pump, especially a volumetric pump adapted for enabling a substantially continuous flow rate of less than 25 ml in one minute, advantageously of less than 10 ml in one minute, preferably of less than 5 ml in one minute (such as 3 ml in one minute, 2 ml in one minute or even lesser), most specifically a peristaltic pump, said pump being adapted for conducting to the open end the requested amount of coating composition so that after distribution of the coating composition on the element by the swab, a substantially uniform coating coats the element.

Advantageously, the swab is adapted for absorbing a portion of the coating composition flowing out of the open end of the conducting means.

Preferably, the open end is placed with respect to the swab, so that when the swab contacts the element to be coated, the open end of the conducting means does not contact the element to be coated. Most preferably, the open end of the conducting means is adapted for forming a drop of coating composition at said open end, and in which the open end of the conducting means is placed with respect to the swab, so that when the swab contacts the element to be coated, the drop formed at said open end contacts the element to be coated.

According to an embodiment, the peristaltic pump is working on a flexible pipe having an inner diameter of less than 5 mm, advantageously a inner diameter of less than 2 mm, an inner diameter of less than 1 mm, most preferably a inner diameter comprised between 0.100 mm and 1 mm, such as 200 $\mu$m, 300 $\mu$m, 500 $\mu$m, 750 $\mu$m, etc.

According to a detail of an embodiment, the device is provided with a container for the coating composition to be pumped by the volumetric pump, preferably a peristaltic pump, whereby said container is provided with a mixing means.

Advantageously, the carrier of the open end is the mobile carriage, the conducting means having a portion connected to the mobile carriage, whereby ensuring a movement of the open end with respect to the element to be coated, when the swab is moved with respect to the element to be coated.

The device comprises for example:

a flexible pipe with a inner diameter of less than 2 mm extending from a first open end up to a second open end, whereby the volumetric pump, preferably the peristaltic pump, is connected to or working on a portion of said flexible pipe, a container for the coating composition to be pumped by the volumetric pump, preferably a peristaltic pump, whereby said container is provided with a mixing means and with a guiding path for positioning at least the first open end of the flexible pipe.

Preferably, the first open end of the flexible pipe is placed substantially at the level of the mixing means.

The invention relates also to a device for coating at least a part of an element by means of a swab, said device comprising:

a support provided with a guiding path and with a means for bearing the element to be coated;

a mobile carriage with means for bearing the swab, said carriage being movable along the guiding path;

a means for ensuring a movement of the mobile carriage along the guiding path with respect to the element to be coated, whereby ensuring a relative movement of the swab with respect to the element to be coated, a means for conducting coating composition comprising at least a flexible pipe with a inner diameter of less than 2 mm extending from a first open end to a second open end, whereby the second open end of the flexible pipe is mounted on a carrier movable along a guiding path with respect to the element to be coated, the second end being located with respect to the swab, so that the composition flowing out from the open end contacts first the element to be coated before being distributed by the swab, and a means for pushing the swab towards the element to be coated so that the swab acts as means for distributing the coating composition flowing out of the open end, whereby the means for conducting the coating composition comprises:

a container for the coating composition, whereby said container is provided with a mixing means and with a guiding path for positioning at least the first open end of the flexible pipe, a volumetric pump, preferably a peristaltic pump acting on a portion of the flexible pipe, said pump being adapted for conducting from the first open end of the flexible pipe to the second open end of the pipe the requested amount of coating composition so that after distribution of the coating composition on the element by the swab, a substantially uniform coating coats the element.

For example, the swab is adapted for absorbing a portion of the coating composition flowing out of the second open end of the pipe.

According to an embodiment, the second open end is placed with respect to the swab, so that when the swab contacts the element to be coated, the second open end of the pipe does not contact the element to be coated.

Preferably, the second open end of the pipe is adapted for forming a drop of coating composition at said second open end, and in which the second open end of the pipe is placed with respect to the swab, so that when the swab contacts the element to be coated, the drop formed at said second open end contacts the element to be coated.

According to an advantageous embodiment, the second open end of the pipe extends at least partly in an plane forming an angle comprised between 5 and 85° with respect to a transversal plane of the pipe, such as an angle comprised between 15 and 75° with respect to a transversal plane of the pipe, most preferably an plane forming an angle comprised between 30 and 60° with respect to a transversal plane of the pipe, such an angle of 40°, 45°, 50°.

According to a detail of an advantageous embodiment, the second open end of the pipe is located at less than 10 mm from the swab, such as at a distance comprised between 0.1 mm and 8 mm, for example at a distance comprised between 0.5 mm and 6 mm, such as 1 mm, 3 mm, 5 mm. Possibly a means can be provided for controlling the distance between the swab and the second open end of the flexible pipe.

According to a detail of an embodiment, the device is provided with a container for the coating composition to be pumped by the peristaltic pump, whereby said container is provided with a mixing means. Said container can be provided with means for controlling the temperature of the coating composition and/or for controlling the gas atmosphere in the container (nitrogen, etc.), and/or for controlling the pressure in the container, etc. The container can be provided with means for protecting the coating composition from UV, etc.

Advantageously, the carrier of the open end is the mobile carriage, the conducting means having a portion connected to the mobile carriage, whereby ensuring a movement of the open end with respect to the element to be coated, when the swab is moved with respect to the element to be coated.

Preferably, the device comprises:

- a flexible pipe with a inner diameter of less than 2 mm extending from a first open end up to a second open end, whereby the volumetric pump is connected to or the peristaltic pump is working on a portion of said flexible pipe,
- a container for the coating composition to be pumped by the volumetric pump, preferably a peristaltic pump, whereby said container is provided with a mixing means and with a guiding path for positioning at least the first open end of the flexible pipe.

Advantageously, the device further comprises a room in which at least the support and the mobile carriage are located, said room being provided with an inlet connected to an air cleaning system.

For example, said inlet is adapted for ensuring a substantially laminar flow at least in the neighbourhood of the support and the mobile carriage.

According to an embodiment of the device of the invention, the device further comprises a table, a vertical supporting element, and fixing means, whereby the support is movable between a first position in which the support is fixed to the table and a second position in which the support is fixed on the vertical supporting element.

The device advantageously further comprises a driving means for driving into rotation the element to be coated.

According to a possible embodiment, the device further comprises a means for varying the pushing of the swab towards the element to be coated varies the said pushing of the swab towards at least a part of the element during the movement of the carriage corresponding to the coating of the said part of the element by the swab, the said pushing varying substantially continuously from a first pushing force and a second pushing force so that the coating of the said part is substantially uniform.

According to a detail of an embodiment, the mobile carriage has a body movable along the guiding path, said body being provided with a pivoting piece bearing the swab. For example, the pivoting piece is pivotable with respect to the body around an axis parallel to the guiding path of the carriage.

The position of the piece can also be adapted in a direction parallel to the axis of the swab or of the rod supporting the swab.

According to another detail, the means for ensuring a movement of the mobile carriage along the guiding path with respect to the element to be coated moves the said mobile carriage according to a back-and-forth motion.

For example, the means for ensuring a movement of the mobile carriage along the guiding path with respect to the element to be coated moves the said mobile carriage according to a back-and-forth motion, wherein at least during a part of the forth motion, the swab contacts the element to be coated, said device further comprising a means for moving the swab and the element to be coated aside during the back motion of the carriage.

The device can also further comprise:

- a means for moving the swab and the element aside after the coating of the element, and/or
- a means for holding the swab and the element aside when the carriage is adjacent to a first position of the guiding path, and/or
- a means for displacing at least a part of the carriage when the carriage is moved away from the said first position, so that the swab contacts the element.

Advantageously, the means for bearing the element to be coated comprises two bearing elements between which the element to be coated is placed, said bearing elements being aligned along a first axis, and in which the mobile carriage is movable along an axis parallel to the guiding path of the carriage, said axis being distant from the said first axis and being not parallel to the said first axis.

For example, the first axis is an axis of rotation of the element to be coated.

According to another possible embodiment, the means for bearing the element to be coated comprises two bearing elements between which the element to be coated is placed, said bearing elements being aligned along a first axis, and in which the mobile carriage is movable along a second axis parallel to the guiding path of the carriage, said second axis forming an angle with a line parallel to the said first axis and crossing the said second axis.

In this embodiment, the angle is advantageously comprised between 0.1° and 15°.

The device can also comprise a means for adapting the pushing force of the swab on the element to be coated after placement of a swab on the mobile carriage and/or a means for adapting the pushing force of the swab on the element to be coated after placement of an element to be coated on the support and/or a protection element movable with respect to the support between a position enabling the coating of the element to be coated and a position protecting at least a first portion of the element after its coating and/or an absorbing element movable with respect to the support between a position aside the element to be coated and a position in which the absorbing element contacts a second portion of the element adjacent to the first portion of the element protected by the protection element.

The invention still relates to a device for coating at least a part of an element by means of a swab, in which a coating composition contacts the support to be coated, said device comprising:

- a support provided with a guiding path and with a means for bearing the element to be coated;
- a mobile carriage with means for bearing the swab, said carriage being movable along the guiding path;
- a means for ensuring a movement of the mobile carriage along the guiding path with respect to the element to be coated, whereby ensuring a relative movement of the swab with respect to the element to be coated,
- a protection element movable with respect to the support between a position enabling the coating of the element to be coated and a position protecting at least a first portion of the element after its coating.

Preferably, said device comprises an absorbing element movable with respect to the support between a position aside the element to be coated and a position in which the absorbing element contacts a second portion of the element adjacent to the first portion of the element protected by the protection element.

A further object of the invention is a process for coating an element with a coating composition, in which a volumetric pump, preferably a peristaltic pump, is used for controlling the flow of a coating composition in a flexible pipe having an open end adjacent to a swab, in which the swab and the open end of the flexible tube are in relative movement with respect to the element to be coated, and in which the swab is contacting the element to be coated for distributing the coating composition flowing from the open end on the element to be coated, whereby the volumetric or peristaltic pump is controlled for conducting to the open end the requested amount of coating composition so that after distribution of the coating composition on the element by the swab, a substantially uniform coating coats the element.

Advantageously, the swab contacts the element in an air clean environment.

Preferably, the swab contacts the element in an air clean environment containing substantially no particles with a size greater than 5 $\mu$m.

For example, the swab contacts the element in an air environment with a temperature comprised between 15 and 30° C. and/or in an air environment with a relative humidity of less than 50% and/or in a substantially laminar clean airflow.

Advantageously, the element is driven in rotation, while the swab contacts the element while rotating.

For example, the swab is pressed with a controlled pressure on the element for obtaining a uniform coating.

Advantageously, the swab is pushed with a pushing force on the element to be coated, while said pushing force is controlled during the relative movement of the swab with respect to the element so as to obtain a uniform coating of the element.

According to a detail of an advantageous embodiment, the open end of the flexible pipe does not contact the element to be coated, when the swab is contacting the element to be coated for distributing the coating composition on the element to be coated.

For example, the open end is adapted for forming a drop of coating composition at said open end, while the open end is placed with respect to the swab, so that when the swab contacts the element to be coated, the drop formed at said open end contacts the element to be coated.

According to an embodiment, the swab is moved with a back-and-forth motion with respect to the element to be coated, while the swab contacts the element during at least a part of the forth motion, the swab and the element being aside during the back motion of the swab.

According to possible embodiment, the coating composition is a composition for obtaining a composition selected from the group consisting of antistatic coatings, anti abrasive coatings and combinations thereof.

BRIEF DESCRIPTION OF THE DRAWINGS

FIGS. 10 to 15 are schematic views of the position of the carriage during its relative movement with respect to the element to be coated (the FIGS. 10 to 15 showing the position of the carriage respectively along the lines X—X, XI—XI, XII—XII, XIII—XIII, XIV—XIV in the support of FIG. 5 during the forth movement of the carriage, while FIG. 15 shows the position of the carriage during the back movement of the carriage);

DESCRIPTION OF PREFERRED EMBODIMENTS

Figure 1:
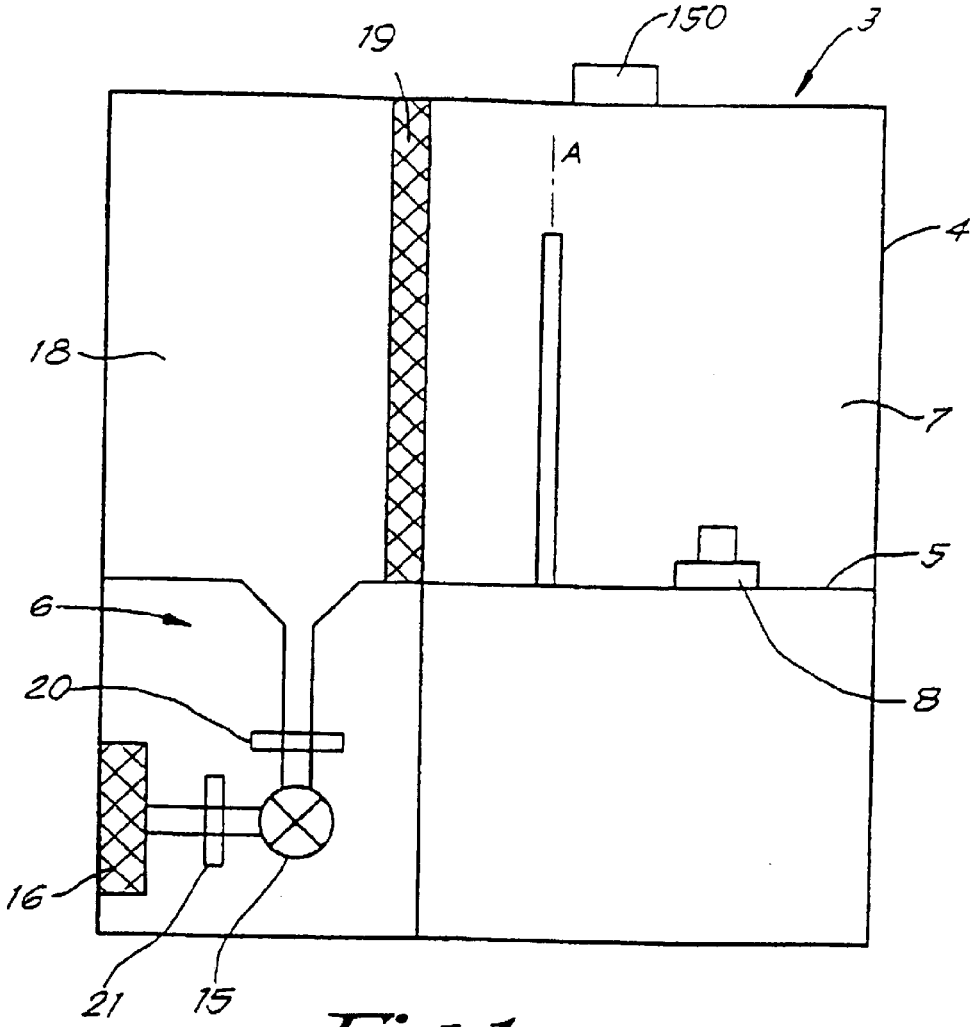
FIG. 1 is a schematic side view of a preferred device of the invention.
Figure 2:
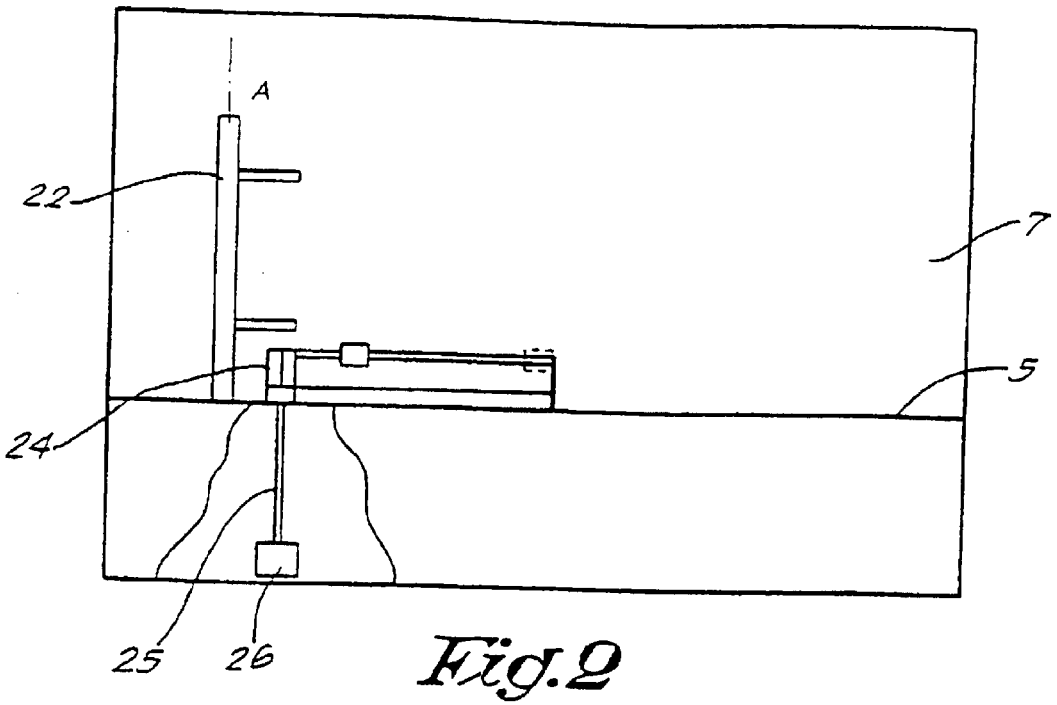
FIG. 2 is a schematic front view of the device of FIG. 1.
Figure 3:
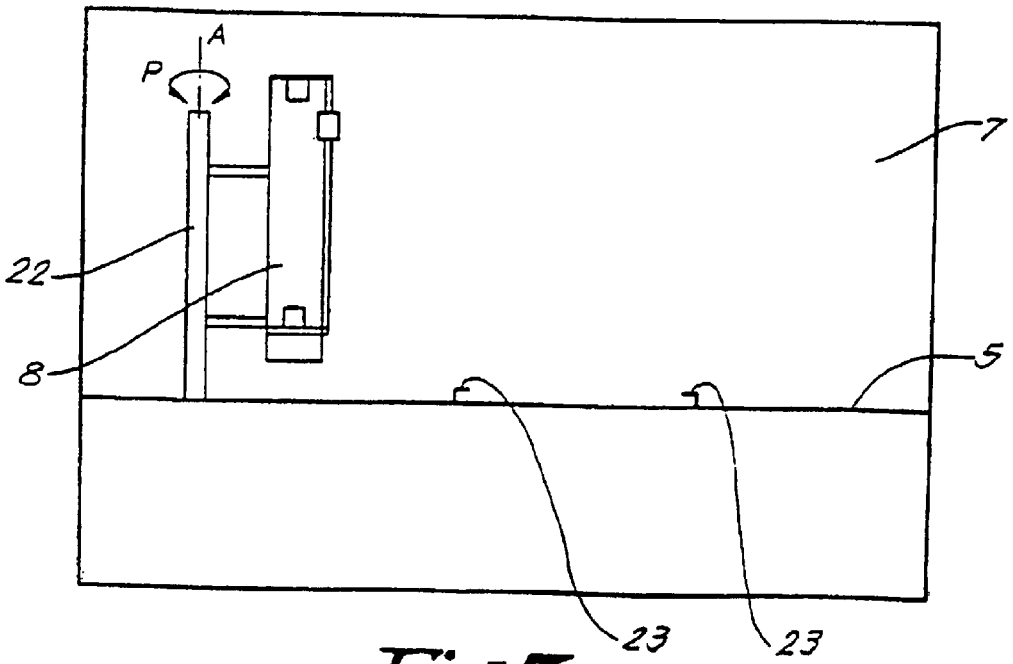
FIG. 3 is a schematic front view of the device of FIG. 1 with the coating device in vertical position.
Figure 4:
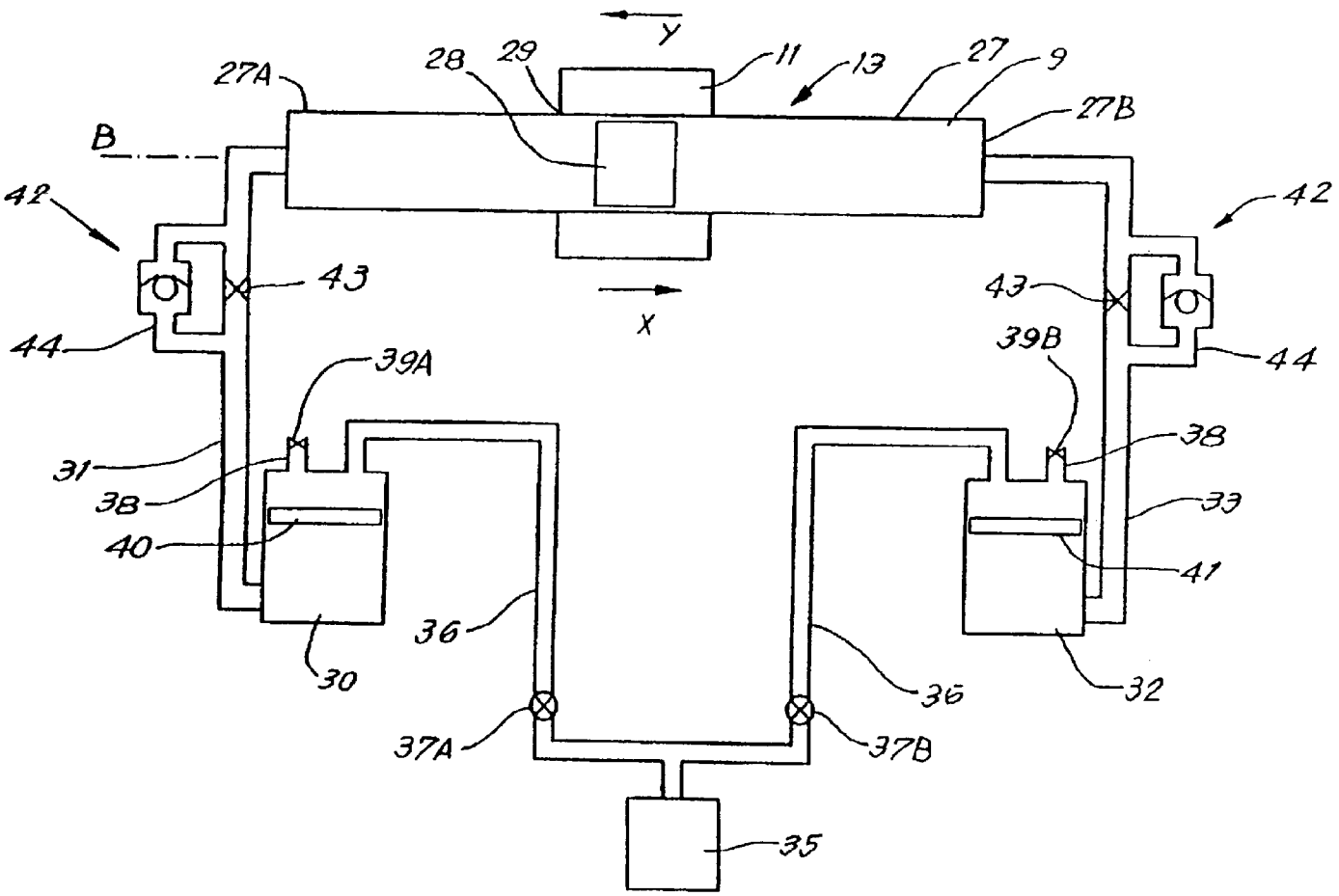
FIG. 4 is a schematic view of the control circuit of the carriage of the coating device.
Figure 5:
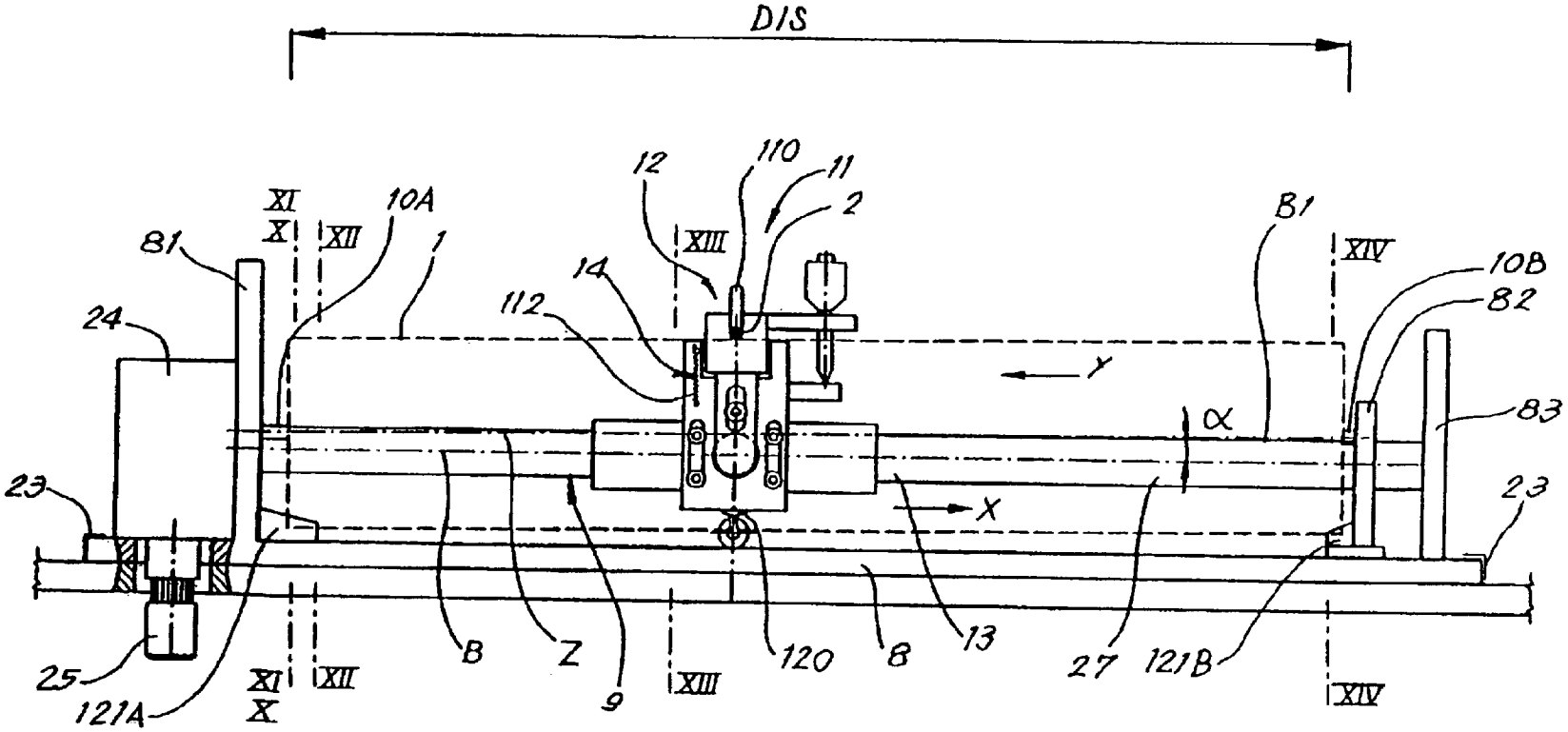
FIG. 5 is a front schematic view of the support provided with the coating device.
Figure 6:
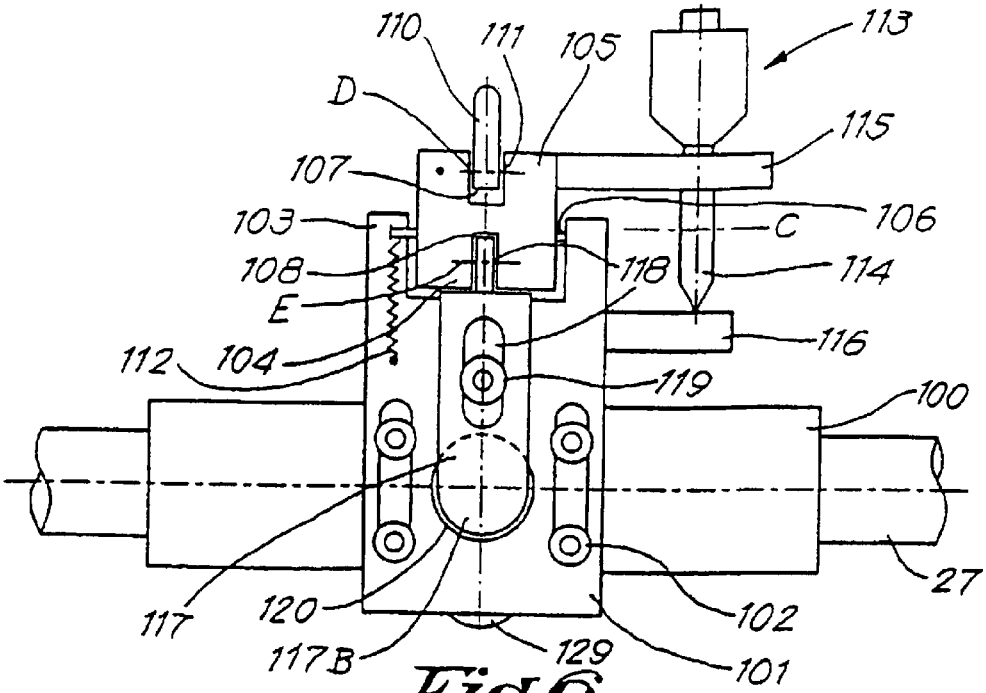
FIGS. 6 to 9 are respectively a front schematic view, a back view and side views of the coating device of FIG. 5.
Figure 7:
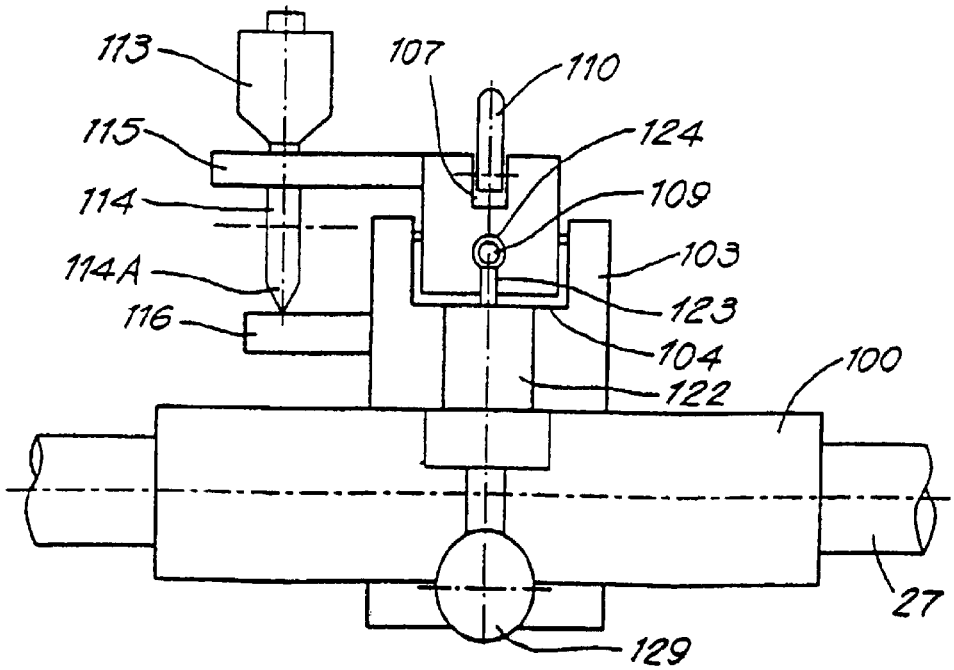

The device shown schematically in FIG. 1 is a device for coating at least a part of an element 1, such as a drum or roller, by means of a swab 2 impregnated with a coating composition, said device comprising:

- a cabinet 3 with a front opening 4, a table 5 and an air cleaning system 6 for controlling environment of at least a part of the working room 7;
- a support 8 provided with a guiding path 9 and with a means 10 for bearing the element 1 to be coated;
- a mobile carriage 11 with means 12 for bearing the swab 2, said carriage being movable along the guiding path 9;
- a means 13 for ensuring a movement of the mobile carriage 11 along the guiding path 9 with respect to the element 1 to be coated;
- a means 14 for pushing the swab towards the element 1 to be coated so that a quantity of the composition released from the swab 2 coats the element, and
- a means for varying the quantity of released composition per unit of length of movement of the mobile carriage along at least a part of the guiding path, so that the coating of the said part is substantially uniform.

The air cleaning system comprises a fan 15 sucking air through an air filter 16 and pushing said sucked air in a distribution room 18 provided with an outlet consisting of a compressible porous foam layer 19, into the working room 7. The fan is controlled so that the air flow entering in the working room is substantially laminar and so that the working room is under a pressure higher than the pressure outside the working room so as to prevent air to flow in the working room 7 through the opening 4. The speed of the laminar flow is for example lower than 2 m/s, for example comprised between 0.05 m/s and 0.5 m/s. The air cleaning system is advantageously provided with a system 20 for controlling the temperature of the air (for example for heating the air at a temperature of 20–30° C.), a system (21) for controlling the relative humidity of the air (for example for obtaining a substantially dry air). Such an air flow (of cleaned air) prevents dust or solid particles to deposit on the coating, for example before the tack free or complete hardening of the composition applied on the element. Such an air flow is also advantageous for preventing the formation of big drop of composition, as possible drop formed on the element is pressed on the element due to the air flow. The control of the temperature of the air flow is also advantageous for controlling the hardening of the composition. The hardening and/or tack free of the composition can therefore be effected in the substantially preferred conditions. Possibly, the temperature of the air flow can be controlled so that the temperature of the air flow during the coating is lower than the temperature of the air flow after the coating. This could be advantageous for preventing as much as possible the hardening of the composition during the coating, while improving or accelerating the hardening of the composition after the end of the coating.

The cabinet 3 provided with a cleaning system as described hereabove is already suitable for coating element with known coating devices using impregnated swab. When using such a cabinet provided with said cleaning system in a coating operation using a known coating device, it is possible to dust or solid particles to deposit on the coating, for example before the tack free or complete hardening of the composition applied on the element. By controlling the air flow, it is possible to prevent the formation of big drops of composition. By controlling the humidity of the air and/or the temperature of the air and/or the speed of air flow, it is possible to have a control of the hardening of the coating or of the time required for obtaining a tack free coating. Possibly, the temperature of the air flow can be controlled so that the temperature of the air flow during the coating is lower than the temperature of the air flow after the coating. This could be advantageous for preventing as much as possible the hardening of the composition during the coating, while improving or accelerating the hardening of the composition after the end of the coating.

The table 5 is provided with a vertical supporting element 22 and with fixing means 23, whereby the support 8 is movable between a first position in which the support is fixed to the table 5 and a second position in which the support 8 is fixed on the vertical supporting element 22. Preferably, the vertical supporting element is mounted pivotable around a vertical axis A. This is advantageous for adapting the direction of air flow with respect to the support, by a simple rotation or pivotment P of the support around the axis A.

The support 8 is provided with a gear mechanism 24 intended to be connected to an axis 25 driven in rotation by a motor 26. The gear mechanism 24 and the axis 25 which can be separated, are advantageously adapted for a direct connection there between. The gear mechanism 24 when driven in rotation drives in rotation the element to be coated, such as a drum or a roller.

In this embodiment, the means for varying the pushing H of the swab 2 towards the element 1 to be coated varies the said pushing of the swab towards the element during the movement of the carriage 11, the said pushing varying substantially continuously from a first pushing force and a second pushing force so that the coating of the said part is substantially uniform. For example, in case of a vertical pushing of the swab towards the element to be coated, the said pushing varying substantially continuously from a first pushing force and a second pushing force higher than the first pushing force so that the coating is substantially uniform, while for a horizontal pushing of the swab towards the element, the said pushing varying substantially continuously from a first pushing force and a second pushing force lower than the first pushing force so that the coating is substantially uniform.

The guiding path of the carriage 11 can take various forms. For example, said guiding path is a circuit provided with balls, sliding rail(s), a rod for example of a jack, etc.

However, the guiding path 9 of the carriage 11 comprises advantageously a cylinder 27 in which a magnetic piston 28 is movable. The carriage 11 has a cylindrical hole 29 in which the cylinder 27 is engaged, whereby the carriage can slide along the cylinder 27. The carriage is made in a material so that the said carriage, due to the magnetic field of the piston 28, follows the movement of the piston. For the movement of the piston 28, the cylinder 27 is connected at a first end 27A to a jack 30 through a conduit 31, and at a second end 27B to a jack 32 through a conduit 33. The jacks 30,32 are connected to a means 35 through conduits 36 provided with a control valve 37A,37B. The jacks 30,32 are provided with a gas outlet 38 with a control outlet valve 39A,39B. The cylinder 27 and the parts of the jacks 30,32 connected thereto are filled with a hydraulic fluid, such as water, oil, etc. When the valve 37A is open (valve 37B closed, valve 39A closed), pressurized air flows in the upper part of jack 30, whereby moving piston 40 downwards, so that hydraulic fluid flows from jack 30 towards the cylinder 27. This flow of hydraulic fluid induces a movement of the piston 28 towards the end 27B and thus a movement of the carriage towards said end 27B, as well as a flow of hydraulic fluid from the cylinder 27 towards jack 32. The valve 39B is open, so that air can be removed from the upper part of the jack 32 during the upwards movement of the piston 41 due to the flow of hydraulic fluid in the jack 32. For having a movement of piston 28 towards the end 27A, pressurized air is lead into the upper part of jack 32 (valve 39B closed, valve 37B open, valve 37A closed, valve 39A open) so as to move piston 28 towards the end 27A. Hydraulic fluid of the cylinder 27 flows then in the jack 30. The valve 39A is open for enabling the outlet of air during the upwards movement of piston 40. For ensuring a correct control of the movement of the piston (magnetic piston), the conduits 31 and 33 are provided with a system 42 comprising a means 42 for limiting the flow of hydraulic fluid from the jack 30 to the cylinder 27 or the flow of hydraulic fluid from the jack 32 to the cylinder 27, said system further comprising a by pass 44 for permitting a flow (with a low pressure) of fluid from the cylinder to the jack 30 or from the cylinder 27 to the jack 32. By using this mechanism, the carriage 11 is movable according to a forth-and-back movement (X,Y). In the drawings, the forth motion is drawn as being a movement from the left towards the right. It is obvious that the device can be adapted so that the forth motion corresponds to a motion from the right to the left.

The carriage 11 comprises:

- a body 100 with the cylindrical hole 29 in which the cylinder 27;
- a piece 101 attached to the body 100 by means of screws 102, said piece 101 having two arms 103 defining there between a channel 104;
- a piece 105 connected to the arms 103 by means of a pivot 106, whereby said piece 105 can pivot around the axis C, said piece 105 having an back rod 109, an upper groove 107 and a downwards recess 108;
- a plate 110 partly engaged in the upper groove 107 and connected to the piece 105 by a pivot 111, so that the plate can pivot around an axis D between a position in which the rod 2A of the swab 2 can be engaged between the bottom of the groove 107 and the plate (see FIG. 10) and a position in which the plate 110 acts on the rod 2A for preventing its movement in the groove 107 (see position of the plate in FIG. 11);
- a spring 112 extending between the piece 103 and the piece 105, said spring exerting a force on the piece 105 so that the end 105A provided with the swab 2 moves downwards;
- a means 113 for limiting the downwards movement of the end 105A, said means acting therefore as means for adjusting the pressure of the swab 2 on the element to be coated and as means for adjusting the thickness of the coating on the element, said means 113 comprising for example a control means attached to an arm 115 fixed to the piece 105, said control means controlling the displacement of an adjustable screw or rod 114, the free end 114A of which is intended to work with a plate 116 attached to the piece 101;
- a leg 117 having an upper part 117A engaged in the recess 108 of the piece 105, said upper part 117A being connected to the said piece 105 by means of a pivot 118 whereby the leg can pivot around the axis E, the downwards part 117B of the leg 117 is provided with a roller 120, while the central part of the leg 117 has a groove 118 in which a rod 119 fixed to the piece 105 can slide, the roller 120 being intended to work with a ramp 121 for moving the end 105A of the piece 105 upwards against the action of the spring 112;
- a jack 122 fixed on the piece 105 and/or on the body 100, said jack having a rod 123 provided with plate 124 with an opening in which the back rod 109 of the piece 105 is engaged, when the said jack is actuated the end 105B (opposite to the end 105A) is moved downwards so as to move upwards the swab 2;
- a plate 125 provided with a passage provided with a thread;
- a leg 126, a first end 126A of which is provided with a thread for working with the thread of the passage so as to adjust the position of the leg with respect to the plate 125, while the other end 126B of which is provided with a connecting element 127 to which is connected an arm 128 on which a rod provided with a roller 129 is mounted, the connecting element permitting a rotation of the arm 128 around the axis F of the leg 126 so that when screwing the leg 126 into the passage, the position of the roller 129 can be adjusted, said roller being intended to roll on a part of the support 8 which has a face for example parallel to the axis of the cylinder or in a rail having an axis parallel to the axis of the cylinder, and
- an element 130 attached to the piece 105 adjacent to the end 105A, the position of the free end 130A of which can be adjusted with respect to the piece 105, said element acting as a means for facilitating the correct placement of the swab with respect to the piece 105.

In case, the body can rotate around the cylinder 27, the body or the piece 101 can be provided with a roller 170 (shown in dashed lines in FIG. 8), said roller acting then as means for preventing or limiting a possible rotation of the body towards the element 1 to be coated. In case, a small rotation of the body around the cylinder 27 is admitted or required, the leg 126 can advantageously slide in the said passage as to adjust the position of the leg with respect to the plate 125. A spring 171 extending between the end 126B and the plate 125 exerts a force pushing away the roller 129 from the plate 125, so that the roller 170 and the roller 129 always contacts the support. In case the part on which the roller 129 rolls is not parallel to the axis of the cylinder 27 (for example in case the said part is parallel to the axis of rotation of the element), a slight rotation of the body will occur during the movement of the carriage 11.

The supporting means 8 comprises:

- a first arm 81 provided with a supporting rod 10A possibly driven in rotation by the motor 26 through the gear mechanism 24, said supporting rod being adapted, possibly with a connector, to bear an end of the element, the first arm 81 acting also as means for supporting an end of the cylinder 27;
- a ramp 121A adjacent to the arm 8, said ramp 121 working with the roller 120 for moving upwards the piece 105;
- a second arm 82 provided with a rotating supporting rod 10B being adapted, possibly with a connector, to bear an end of the element 1 and with a ramp 121B working with the roller 120 for moving upwards the piece 105, said arm being attached to the support 8 by fixing means permitting to vary the position of the arm 82 on the support so as to adjust the distance DIS between the arms 81 and 82 in function of the length of the element 1;
- a third arm 83 acting as supporting means of the cylinder 27.

For varying the pushing force H of the swab on the element 1 during the movement of the carriage 11, The bearing elements or rods 10A,10B are aligned along a first axis Z, said axis being the axis of rotation of the element to be coated when the element is rotated during its coating. The mobile carriage is movable along the axis B corresponding to the axis of the guiding path 9. The axis Z forms an angle (with a line B1 parallel to the axis B and crossing the said axis B, said angle being preferably comprised between 0.1° and 15°, for example between 0.1 and 5°, most specifically between 0.2 and 2°.

It means that the pushing force of the swab on the element will vary during the horizontal movement of the carriage 11 between a first pushing force when the carriage is adjacent to the arm 81 and a second pushing force when the carriage is adjacent to the arm 82. The said pushing force varies substantially continuously during the movement of the carriage during a coating operation. This variation of pushing force is due to the fact that during the movement of the swab along the element 1, the piece 105 is submitted to a slight rotation against the action of the spring 112, whereby the pushing force of the swab on the element increases.

When the support 8 is placed vertically, the arm 81 is downwards with respect to the arm 82 and the coating operation is effected during the movement of the carriage from the arm 82 towards the arm 81. During said movement, the pushing force decreases continuously from a maximum pushing force of the swab 2 on the element adjacent to the arm 82 to a minimum pushing force in the neighborhood of the arm 81. The vertical downwards coating is advantageously made only on fixed element (not driven in rotation), such as on doctor blade or wiper blade.

The various position of the swab 2 with respect to the element 1 during the movement of the carriage will now be described.

Figure 10:
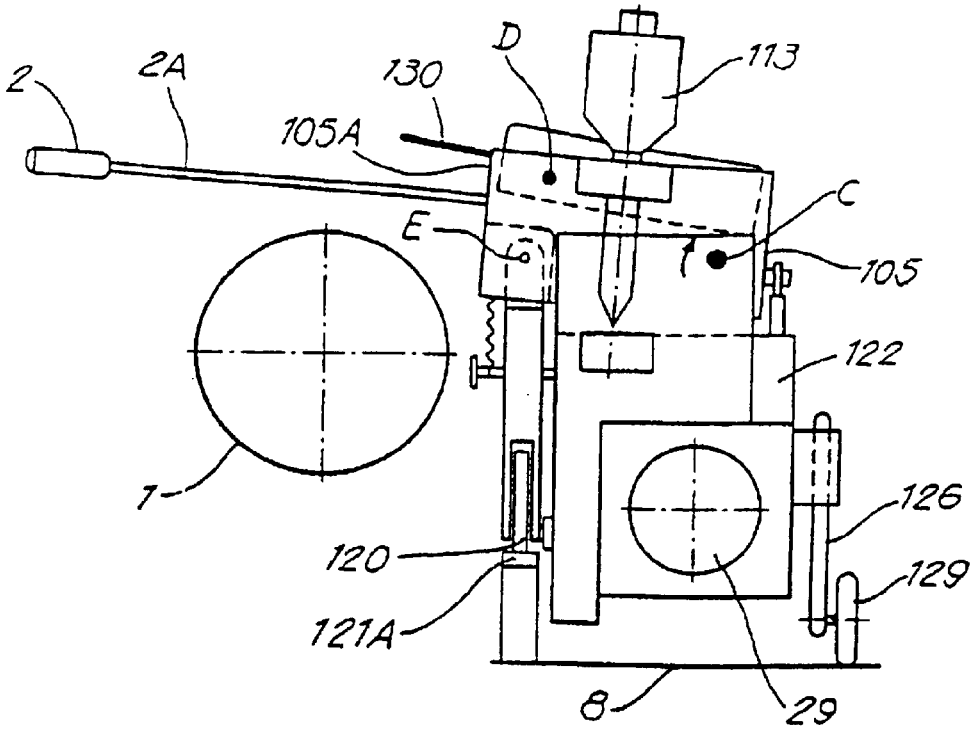

In FIG. 10, the carriage 11 is adjacent to the arm 81. The roller 120 contacts the ramp 121A, whereby the end 105A of piece 105 is rotated upwards with respect to the axis C. The plate 110 is rotated around the axis D so as to form a gap between the plate 110 and the bottom of the groove 107. Due to the upwards movement of the end 105A, the leg 117 is rotated around the axis towards the piece 103. The rod 2A provided with the swab is engaged in the said gap and is adjusted so that the position of the swab 2 corresponds substantially to the end position of the element 130.

Figure 11:
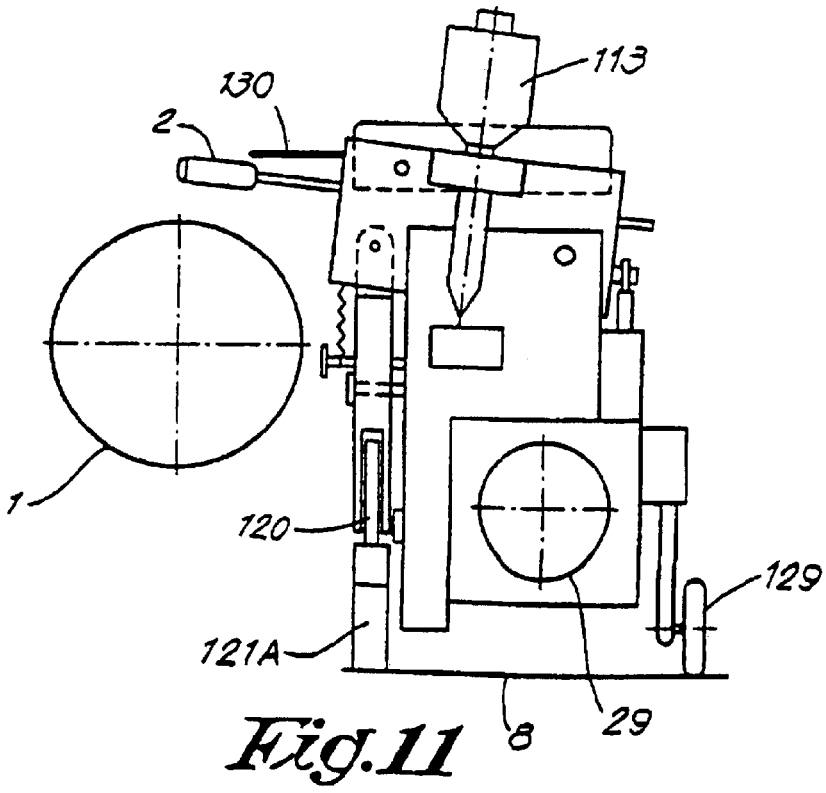

The plate 110 is then rotated around the axis for pressing the rod 2A against the bottom of the groove 107, so that the rod 2A is fixed on the piece 105. (FIG. 11).

The element to be coated placed between the rod 10A and 10B is possibly, but advantageously, driven in rotation.

Figure 12:
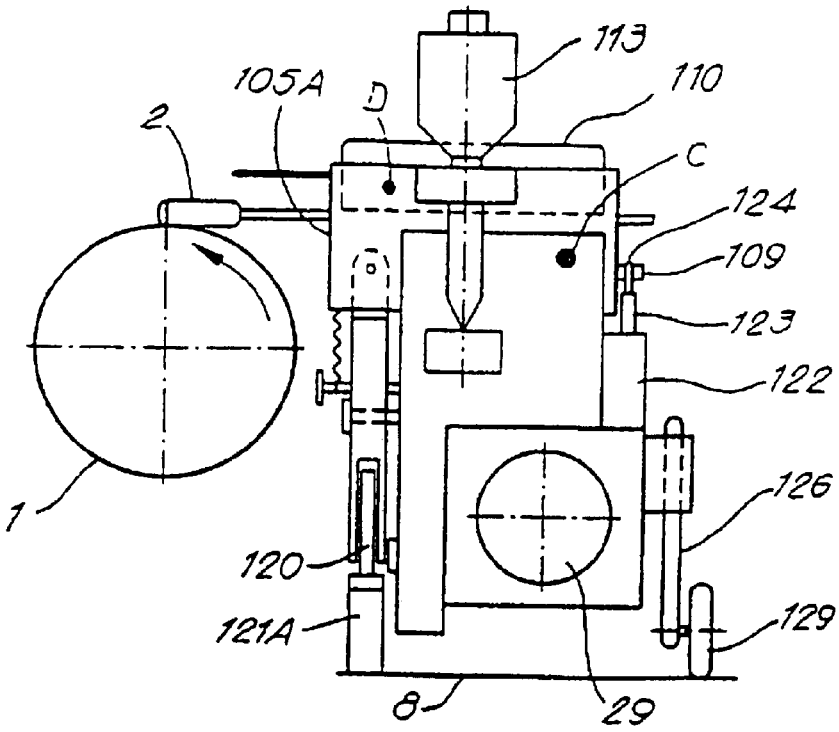

The forward movement X of the carriage 11 is now actuated. The roller 120 rolls downwardly on the ramp 121A, so that the leg 117 does no more exert a force against the action of the spring 112. During said rolling, the end 105A of the piece 105, as well as the swab 2 are moved downwards, so that when the roller does no more contact the ramp 121A, the swab 2 contacts the element 1 to be coated. (FIG. 12)

Figure 13:
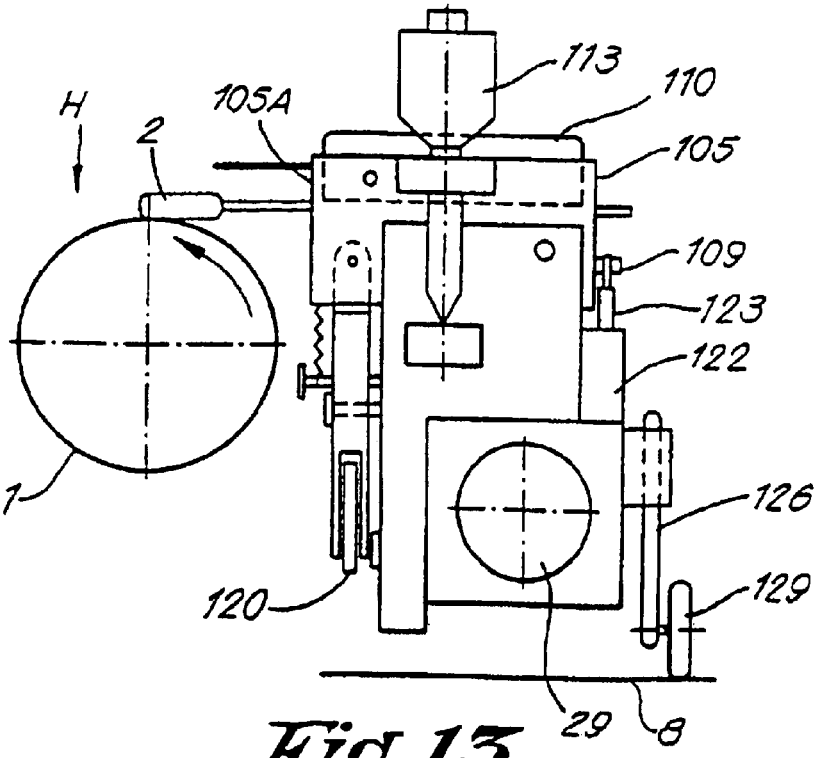

FIG. 13 shows the normal movement of the carriage 11 between the ramps 121A and 121B.

Figure 14:
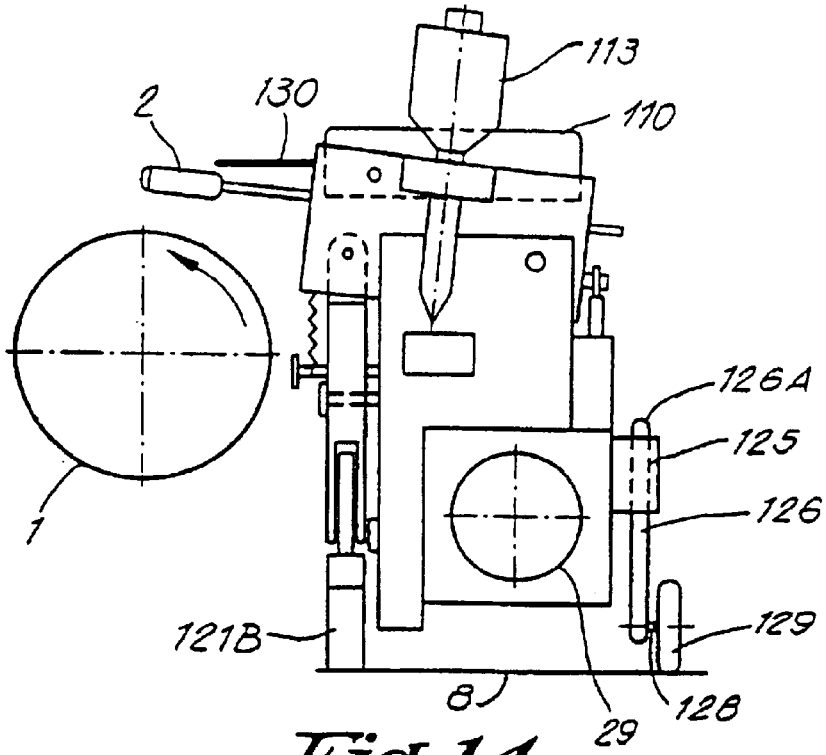

At the end of the coating operation, i.e. in the neighborhood of the arm 82, the roller 120 rolls upwardly on the ramp 121B. This upwards movement of the leg 117 causes an upwards rotation of the end 105A and of the swab 2 with respect to the axis E, whereby the swab no more contacts the element 1 (FIG. 14).

Figure 15:
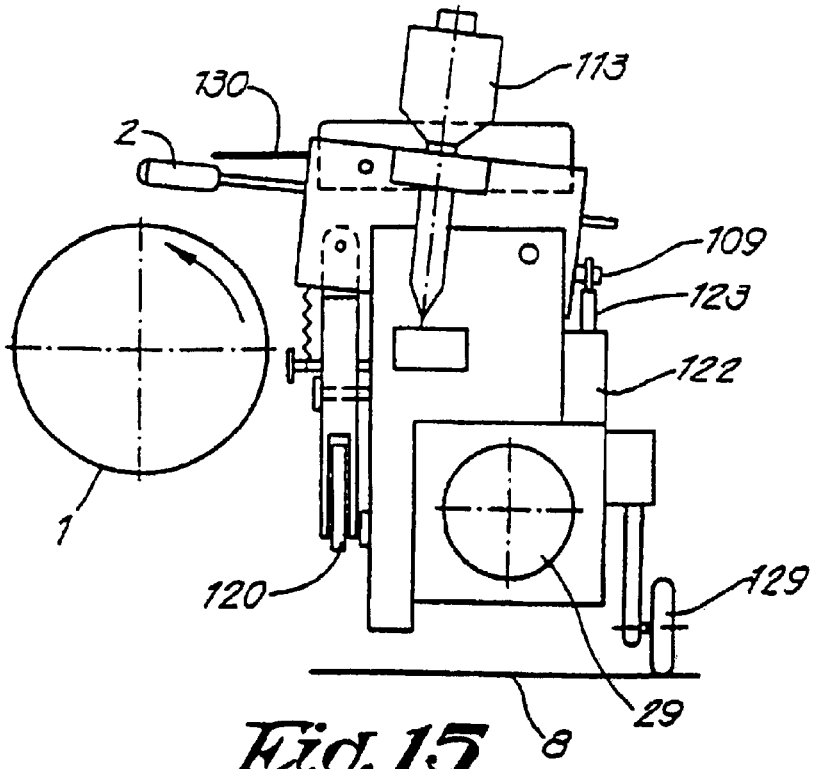

Thereafter, the carriage is moved back (Y) to a position adjacent to the arm 81. During said back movement, the jack 122 is actuated so that the rod 123 is moved downwardly so as to maintain the end 105A and the swab 2 in an upper position, so as to prevent the swab from contacting the element 1. (FIG. 15).

The device shown in the figure has been used for coating drams, magnetic roller, wiper blades and doctor blades of toner assembly, as well for primary charging roller and fuser roller.

When using the device, the atmosphere of the room is advantageously controlled so that the said atmosphere is substantially free of particles with a size greater than 1 $\mu$m and has a temperature of between 15 and 30° C., for example about 20° C. A cleaned air flow, preferably a laminar air flow contacts the element during the coating, but also preferably before the coating and after the coating, for preventing the deposit of dust particles on the element to be coated before coating and on the coating.

For the coating of drums or rollers, the support is preferably substantially horizontal and the element to be coated is preferably driven in rotation (controlled rotation).

The thickness of the coating to be applied on the element is adjusted by the means 113, for example to 100 $\mu$m or to less than 100 $\mu$m, such as 1, 2, 3, 5, 10, 20, 30, 50, 75 $\mu$m. The means 113 can possibly be adjusted s as to obtain thicker coating, such as 200 $\mu$m and more.

The speed of rotation and the speed of movement of the carriage can be controlled as usual for the man skilled in the art for obtaining a coating covering all the part of the drum or roller to be coated.

When using the device of the figures, it is possible to have the swab pressed with a controlled pressure on the element for obtaining a uniform coating.

In the process of the invention, the swab is pushed with a pushing force on the element to be coated and in which the said pushing force is controlled during the relative movement of the swab with respect to the element so as to obtain a uniform coating of the element.

When the coating is made during a horizontal movement of the carriage, the swab is pushed with a vertical pushing force on the element to be coated and in which the said vertical pushing force is controlled during the relative movement of the swab with respect to the element so as that said vertical pushing force varies continuously from a first pushing force to a second pushing force, said second pushing force being greater than the first pushing force.

When the coating is made during a vertical downwards movement of the carriage, the swab is pushed with a horizontal pushing force on the element to be coated, the said horizontal pushing force is controlled during the relative movement of the swab with respect to the element so as that said horizontal pushing force varies continuously from a first pushing force to a second pushing force, said second pushing force being lower than the first pushing force.

When using the device in the process of coating, it is possible to ensure a back-and-forth motion of the swab with respect to the element to be coated. The swab contacts the element during at least a part of the forth motion, while the swab and the element are preferably aside during the back motion of the swab.

Various coating compositions can be used in the process of the invention. Said compositions can be sold in bottles or vials (the swabs having then to be impregnated before use) or as preimpregnated swabs. Preferable compositions are compositions sold by ICT Coatings under the name PCR KIT 1100A and 1500A, MR KIT 1100A, 1500A, 1500B, 1100C and 1500C, DB KIT 1100A, 1500A, 2100A and 2500A. Other compositions can however also be used. Said other compositions are the compositions sold by Cardinal Imaging Supplies under the name Easycoat, Instant Black, Superhard coat, ex super Mag, by Ameri tech Concept under the name PCR Re new, Cyclone Magroller Refinisher, Ultrahard Coat, by KLE under the name PCR Polycoat, PCR Ultracoat, Black Mag Roller Renew, Roller renew, OPC polycoat, Doctor Blade renew.

Possible coating compositions are compositions for obtaining an antistatic and anti abrasive coating, such as conductive and anti abrasive composition.

The invention relates also:

to a process for recycling a toner cartridge comprising at least a magnetic roller and a doctor blade, in which the said doctor blade and magnetic roller are removed from the cartridge, in which the removed doctor blade and magnetic roller are coated with an antistatic and anti abrasive coating, and in which, after coating, the said doctor blade and magnetic roller are placed back in the cartridge;

to a process for recycling a toner cartridge comprising at least a magnetic roller, a doctor blade, a photosensitive drum, a wiper blade, a fuser roller and a primary charge roller, in which the photosensitive drum and the wiper blade are removed from the cartridge, in which the removed photosensitive drum and wiper blade are coated with an antistatic and anti abrasive coating preferably in a device of the invention, and in which, after coating, the said photosensitive drum and the wiper blade are placed back in the cartridge;

to a process for recycling a toner cartridge comprising at least a magnetic roller, a doctor blade, a photosensitive drum, a wiper blade, a fuser roller and a primary charge roller, in which at least three elements selected among the group consisting of magnetic roller, doctor blade, photosensitive drum, wiper blade, fuser roller and primary charge roller are removed from the cartridge, in which the said removed elements are coated with an anti abrasive coating preferably in a device of the invention, and in which, after coating, the said elements are placed back in the cartridge.

Possibly the cabinet 3 can be provided with lamps 150, for example coloured lamps, red lamps, etc. and/or with panels acting as filter, for preventing the passage in the room of specific luminous waves.

Figure 8:
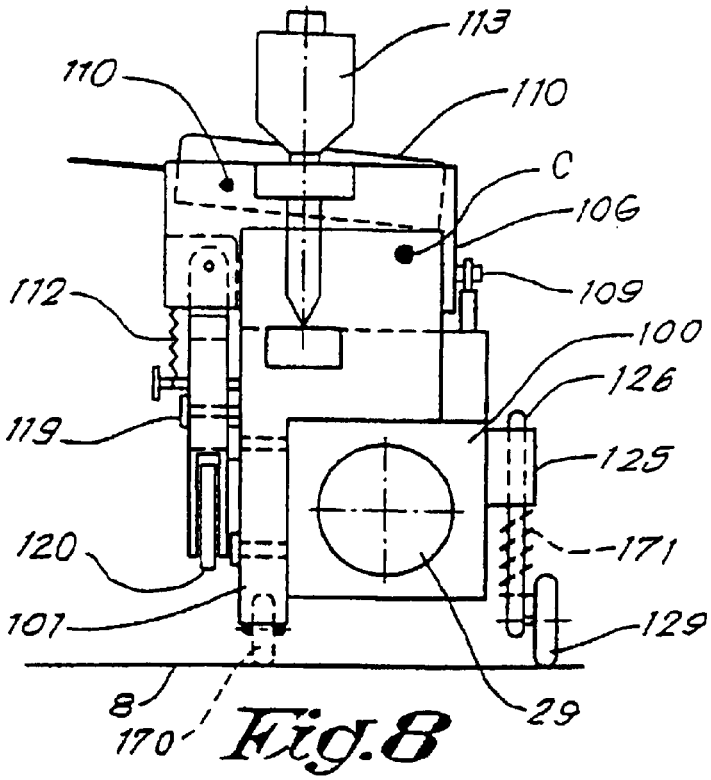
Figure 9:
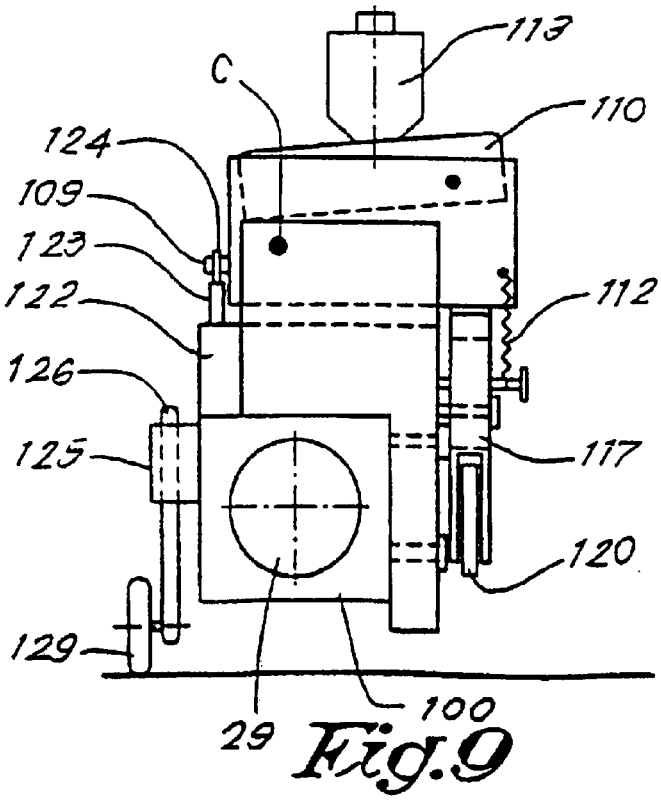
Figure 16:
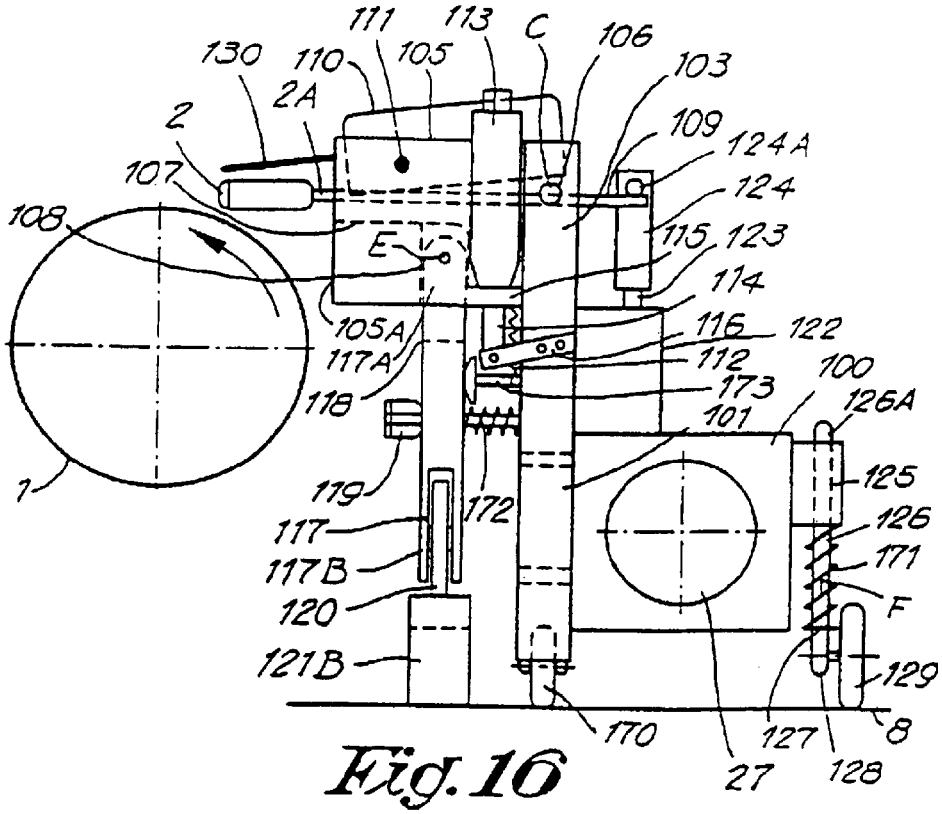
FIG. 16 is a view of an embodiment of the carriage of the coating device, said view being similar to that of FIG. 8.
Figure 17:
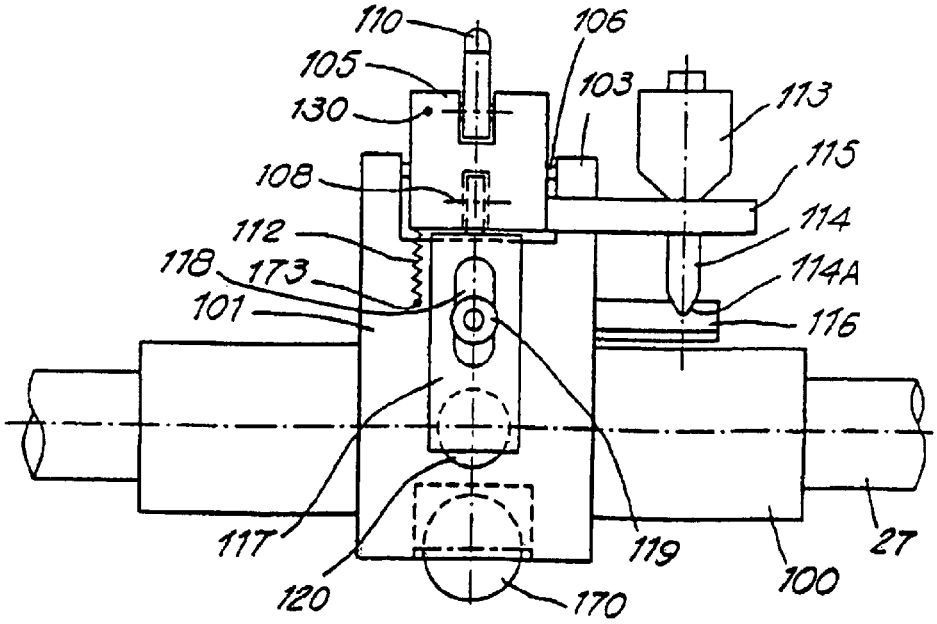
FIG. 17 is a front view of the embodiment shown in FIG. 16.

FIG. 16 is a view similar to that of FIG. 8, but for another embodiment of the carriage 11. Said embodiment is similar to that of FIG. 8, so that only a schematic side view is given.

The carriage 11 of FIG. 16 comprises:

a body 100 with the cylindrical hole 29 in which the cylinder 27;

a piece 101 attached to the body 100, said piece 101 having two arms 103 defining there between a channel;

a piece 105 connected to the arms 103 by means of a pivot 106, whereby said piece 105 can pivot around the axis C, said piece 105 having an back rod 109, an upper groove 107 and a downwards recess 108;

a plate 110 partly engaged in the upper groove 107 and connected to the piece 105 by a pivot 111, so that the plate can pivot around an axis between a position in which the rod 2A of the swab 2 can be engaged between the bottom of the groove 107 and the plate and a position in which the plate 110 acts on the rod 2A for preventing its movement in the groove 107;

a spring 172 extending between the piece 101 and the leg 117, said spring exerting a force on the leg 117 so as to push said leg away from the piece 101;

a spring 112 extending between a rod 173 fixed on the piece 101 and the piece 105;

a means 113 for limiting the downwards movement of the end 105A, said means acting therefore as means for adjusting the pressure of the swab 2 on the element to be coated and as means for adjusting the thickness of the coating on the element, said means 113 comprising for example a control means attached to an arm 115 fixed to the piece 105, said control means controlling the displacement of an adjustable screw or rod 114, the free end 114A of which is intended to work with a plate 116 attached to the piece 101;

a leg 117 having an upper part 117A engaged in the recess 108 of the piece 105, said upper part 117A being connected to the said piece 105 by means of a pivot 118 whereby the leg can pivot around the axis E, the downwards part 117B of the leg 117 is provided with a roller 120, while the central part of the leg 117 has a groove 118 in which a rod 119 fixed to the piece 105 can slide, the roller 120 being intended to work with a ramp 121B for moving the end 105A of the piece 105 upwards against the action of the spring 112;

a jack 122 fixed on the body 100, said jack having a rod 123 provided with plate 124 with a rod 124A acting on the back rod 109 of the piece 105 for moving upwardly the end 105A (when the said jack is actuated the end 105B (opposite to the end 105A) is moved downwards so as to move upwards the swab 2);

a plate 125 provided with a passage;

a roller 170 mounted on the piece 101, said roller being adapted for rolling on the support 8;

a leg 126, a first end 126A of which is engaged in the passage of the plate 125 so that the said leg can slide in the said passage as to adjust the position of the leg with respect to the plate 125, while the other end 126B of which is provided with a connecting element 127 to which is connected an arm 128 on which a rod provided with a roller 129 is mounted, the connecting element permitting a rotation of the arm 128 around the axis F of the leg 126, a spring 171 extending between the end 126B and the plate 125 so as to exert a force pushing away the roller 129 from the plate 125, and an element 130 attached to the piece 105 adjacent to the end 105A, the position of the free end 130A of which can be adjusted with respect to the piece 105, said element acting as a means for facilitating the correct placement of the swab with respect to the piece 105.

Figure 18:
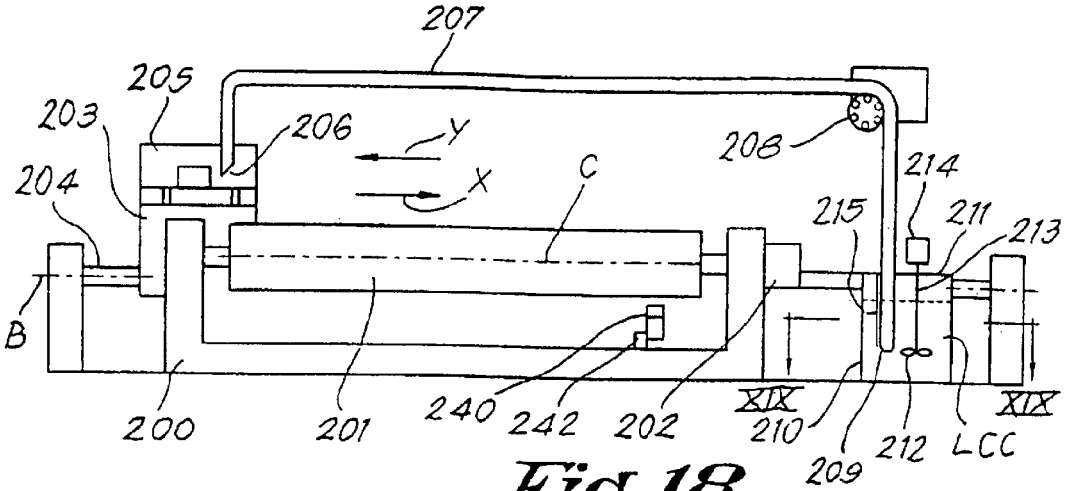
FIG. 18 is a schematic partial view of another embodiment of a device of the invention.
Figure 19:
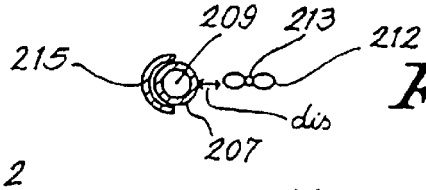
FIG. 19 is a cross section view of a detail of the device of FIG. 18, FIGS. 20 to 23 are views of coating steps with the device of FIG. 18, FIGS. 24 and 25 are enlarged views of the swab and the open end of the pipe.

The device of FIG. 18 can be provided with a clean chamber or room of the type disclosed in FIG. 1.

Figure 24:
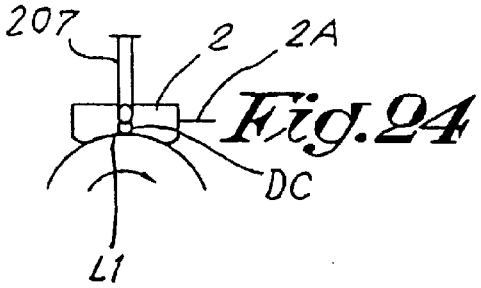
Figure 25:
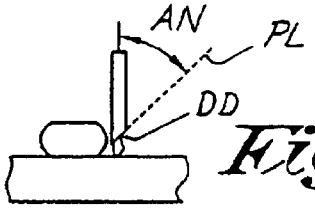
Figure 26:
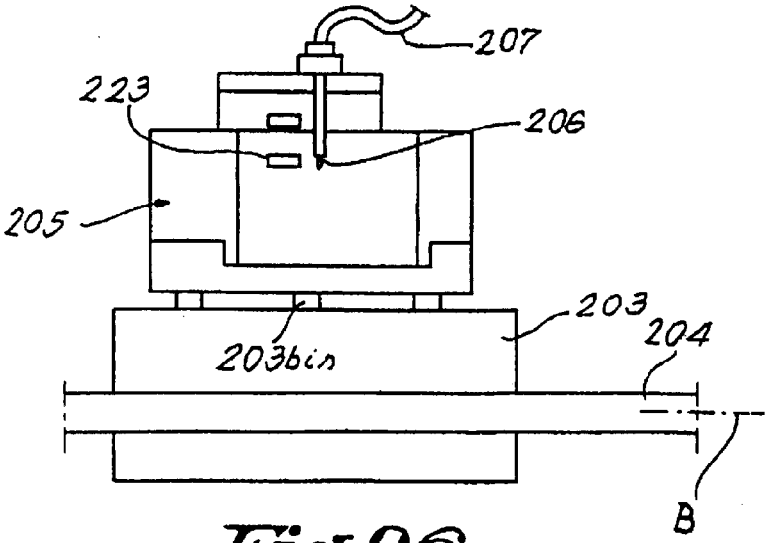
FIG. 26 is a schematic view of a mobile carriage suitable for the device of FIG. 18.
Figure 27:
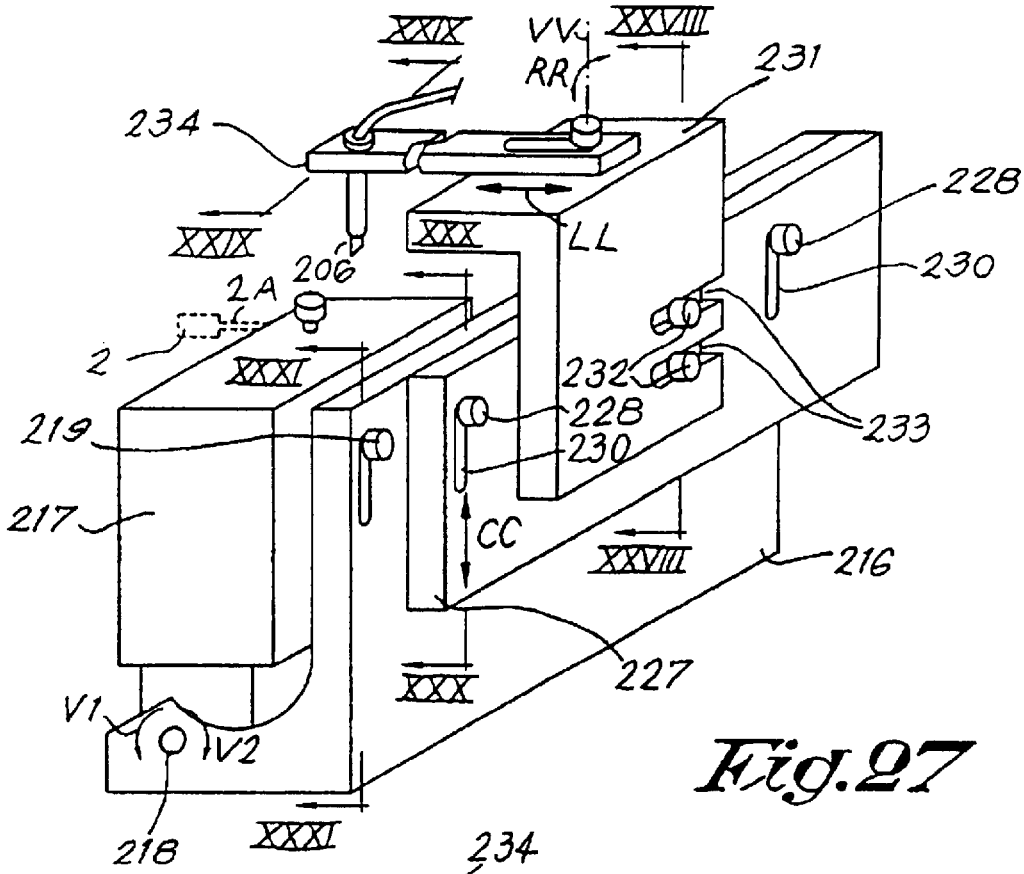
FIG. 27 is a perspective view of the upper part of the carriage of FIG. 26.
Figure 28:
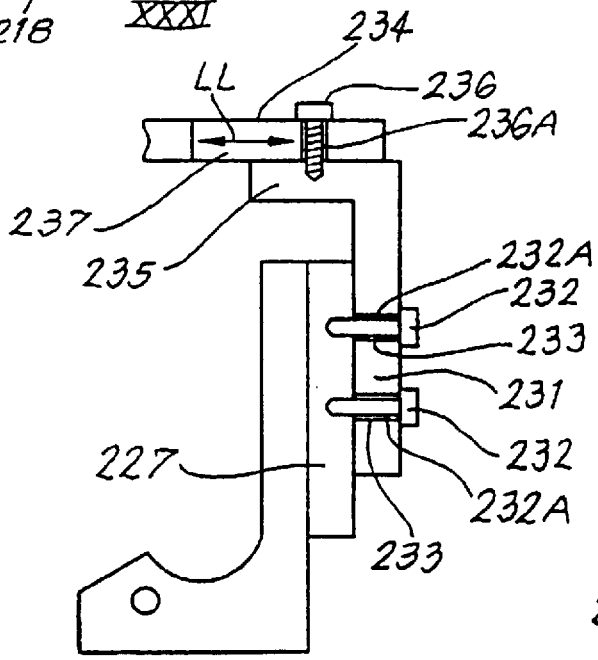
FIG. 28 is a cross section view along the line XXVIII—XXVIII of the upper part of FIG. 27.
Figure 29:
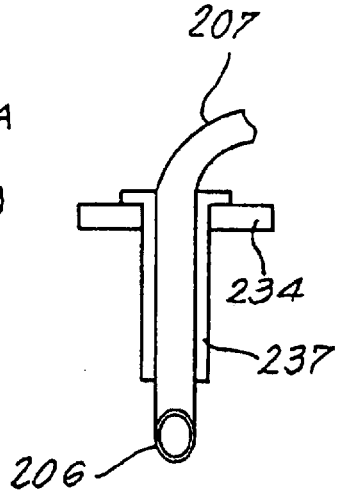
FIG. 29 is a cross section view along the line XXIX—XXIX of the upper part of FIG. 27.
Figure 30:
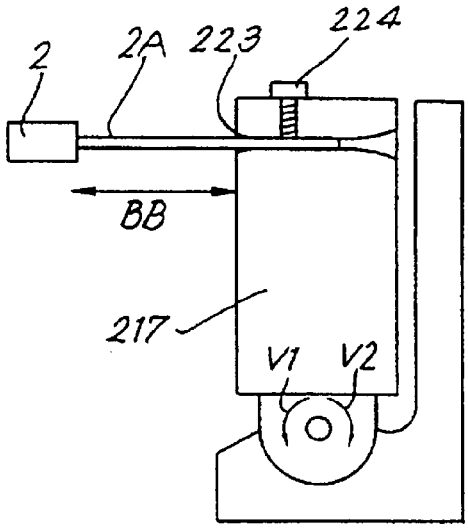
FIG. 30 is a cross section view along the line XXX—XXX of the upper part of FIG. 27.
Figure 31:
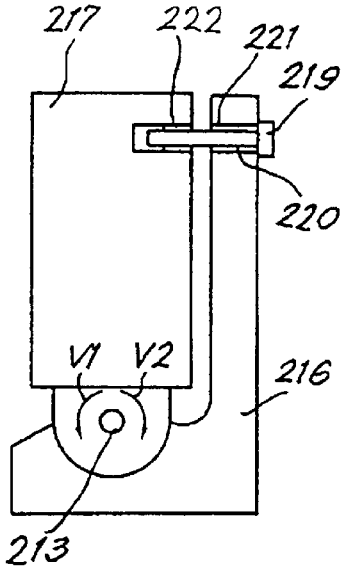
FIG. 31 is a cross section view along the line XXXI—XXXI of the upper part of FIG. 27.

The device of FIG. 18 comprises:

a support 200 for bearing the element to be coated (201, a cylinder in this case), the support 200 being associated with a motor 202 for driving in rotation the cylinder during a coating operation, a mobile carriage 203 able to move (X,Y) horizontally along the guiding rail 204, the axis of which B is parallel to the axis C of the cylinder 201 a system 205 mounted on the carrier 203, said system being movable vertically (W) with respect to the carrier 203 (for example by a jack (203*bis*), pneumatic means, electromotor, etc.), said system 205 bearing the rod 2A (see in FIG. 24) provided with the swab 2, as well as the free open end 206 of the flexible pipe 207, a portion of which cooperates with a peristaltic pump 208, the other open end 209 of the flexible pipe being introduced in a container 210 containing the coating composition LCC the container 210 provided with a cover 211 and a mixing element 212 mounted on a shaft 213 driven in rotation by a motor 214 (the mixing means can possibly be an element dipped in the container and mixed electromagnetically).

The peristaltic pump 8 is working as a volumetric pump. Said pump is advantageously a pump suitable for ensuring a substantially continuous flow of liquid coating composition of less than 25 ml per minute, such as less than 15 ml per minute, especially less than 5 ml per minute, for example 3 ml/minute, 2 ml/minute or even lesser, such as 1 ml/minute.

The flexible pipe 207 is positioned in the container 210 by means of a guiding element 215, in which the flexible pipe is for example clamped. Said guiding element ensures that the end 209 of the pipe 207 remains at a well determined position, for example substantially at the level of the mixing element 212, for example at a distance "dis" of less than 15 mm, such as at a distance of less than 10 mm.

The mobile carriage 203 is better shown in FIGS. 26 to 31. The system 205 enables to adapt the position of the swab 2, as well as the position of the free end 206 of the pipe with respect to the pipe 207.

The system comprises for example:

a support element 216 attached to the rod of a jack so as to enable a vertical displacement of the support element 216 with respect to the mobile carriage 203;

a bearing piece 217 attached to the support element 216 by means of a pivoting shaft 218, whereby the position of the bearing piece can be adapted by pivotement (V1,V2). The relative position of the bearing piece 217 with respect to the support element 216 can be adapted and maintained by means of a screw 219, the rod 220 of which extends through an opening or slot 221 of the support element 216, while the end of the rod is screwed in the screw 222 attached to the bearing piece 217. By screwing the rod 220, it is possible to adapt and control the rotation V1,V2 of the bearing piece with respect to the shaft 218 shaft, whereby adapting the position of the swab 2. The bearing piece is provided with a passage 223 adapted for receiving the rod 2A bearing the swab 2. By pushing more or less the rod 2A in the passage 2A, it is possible to adapt the distance BB between the swab 2 and the bearing piece 217. A screw 224 can be used for maintaining the position of the rod. Other mechanical system can be used for maintaining the position of the rod, such as system using springs, lever, cams, anti tearing mechanisms, for example mechanism enabling the introduction of the rod 2A in the passage 223, while pushing the swab 2 towards the inlet of the passage, but avoiding the removal of the rod 2A as long as a lock mechanism (cam, etc.) is not unlocked (for example by means of a lever). Such a lock mechanism is moreover preferably adapted for avoiding any movement of the swab towards the passage 223, as long as a minimal pushing force is not exerted. The bearing piece can also be provided with an arm provided with reference signs or distance signs, said arm being adapted for being moved so as to adapt the position of its free end, whereby facilitating the correct position of the swab with respect to the bearing piece 217, i.e. the distance separating the swab from the bearing piece.

an intermediate plate 227 attached to the bearing element 216 by two screws 228, the rod of which extend in vertical opening or slot 230, whereby enabling to move the intermediate plate 216 in the direction CC with respect to the bearing piece 216 (the end of the rod of the screw 228 being screwed in a screwed recess of the bearing piece), a L-shaped profile 231 which is attached to the plate 227 by means of screws 232, the rod 232A of which extends in horizontal opening or slot 233 so as to enable a horizontal movement HH with respect to the plate 227, the end of each screw 228 are screwed in a recess 234 of the plate 227, an arm 234 attached to the wing 235 of the L-shaped piece 231, by means of a screw 236, the rod 236A extend in an opening or slot 237 enabling a rotation RR of the arm 234 around the axis VV, as well as a longitudinal movement LL, whereby enabling to adapt the position of the end of the arm 234 in two orthogonal directions, a sleeve 237 attached to the end of the arm 234, said sleeve having a passage for a portion of the pipe 207, the open end 206 extending outside the sleeve.

Such a system enables thus to adapt the relative position of the open end 206 of the pipe with respect to the swab in three orthogonal directions.

The pipe 207 has an inner diameter of 1 mm, and an outer diameter of 1.4 mm.

The use of the device of FIG. 18 will now quickly be disclosed.

Figure 20:
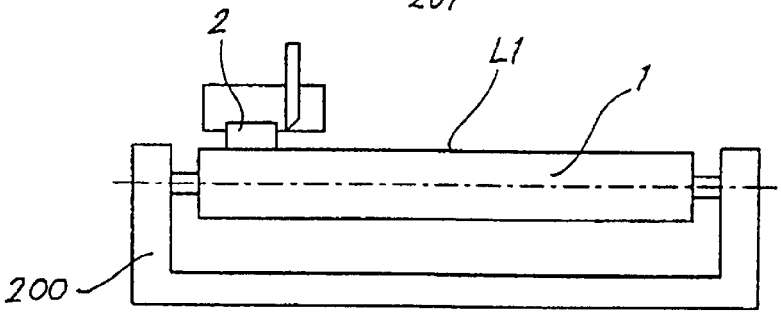
Figure 21:
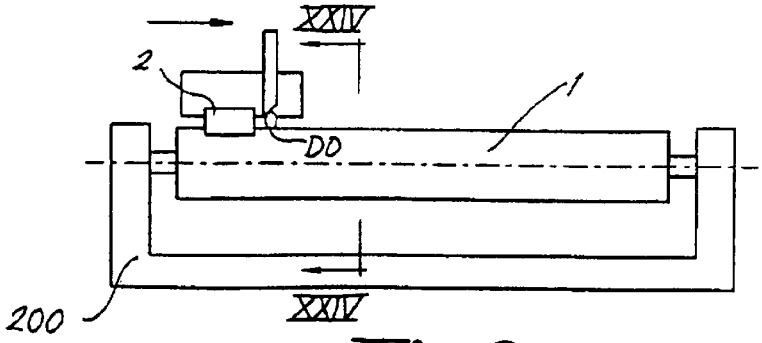

After adapting the position of the swab 2 and the relative position of the open end 206 of the pipe 207 with respect to the swab 2, the device moves the carriage 203 and the system so that the swab 2 contacts the upper line L1 of the piece to be coated without exerting any pressure (FIG. 20).

The device moves then the carriage and the system 205 back in their position of FIG. 18.

The cylinder is now moved in rotation. The device moves then the carriage 203 and the system 205 so that the swab contact the cylinder 1 with a predetermined pressure (see FIG. 24). The peristaltic pump was in action so as to conduct coating composition towards the end 206. A drop DD is formed at said end 206, said drop contacting the cylinder, while the free end 206 of the pipe does not contact the cylinder 1.

For ensuring the formation of a good drop and for facilitating its removal, the end 206 of the pipe is cut so as to extend in a plane PL1 forming an angle AN with the axis of the pipe 207 adjacent to said end.

Figure 22:
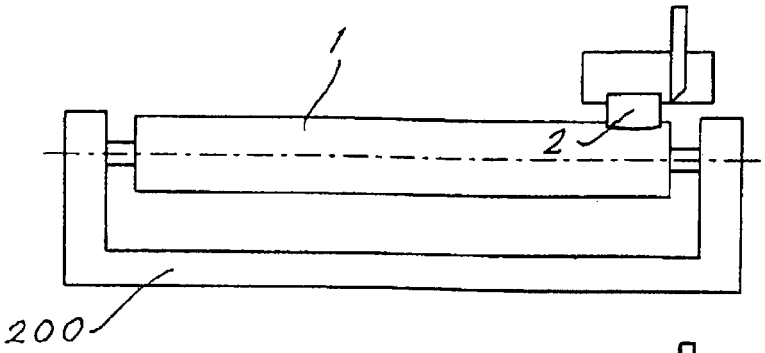
Figure 23:
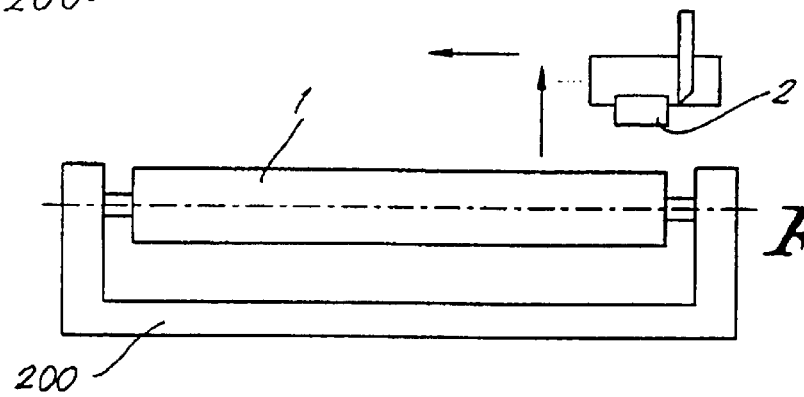

The swab is then moved so as to coat substantially all the surface of the cylinder 1 (FIG. 22).

At said moment, the system is moved, so that the swab 2 is away of the cylinder 1.

The carriage 203 is then moved back to its position of FIG. 18.

Figure 32:
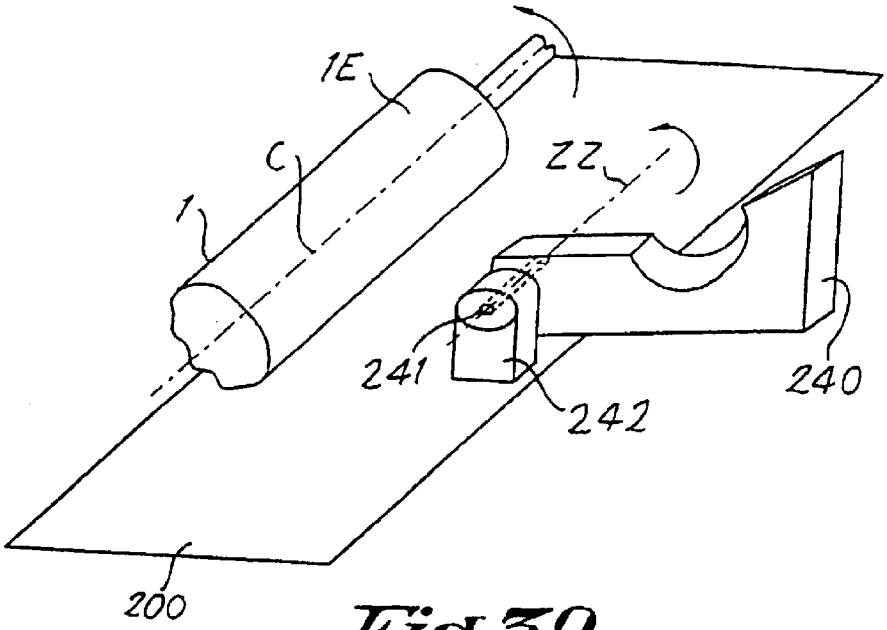
FIG. 32 is a partial perspective view of a detail of the device of FIG. 18.
Figure 33:
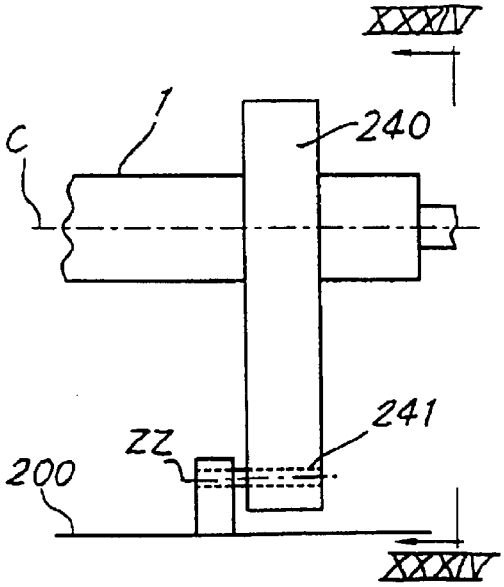
FIG. 33 is a front view of the detail of FIG. 22 after rotation.
Figure 34:
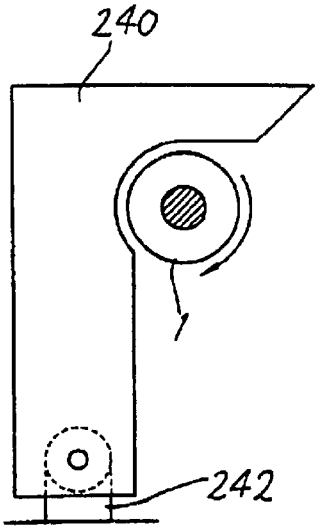
FIG. 34 is a cross section view along the line XXXIV—XXXIV in FIG. 33.

At the end of the coating operation, an end portion of the cylinder has been coated although said end portion 1E has to remain uncoated. For removing said coating on the end portion, and only said coating on said end portion, the device is provided with an arm 240 able to pivot between a position away from the cylinder (FIG. 32) and a position in which the arm 240 protects a portion of the cylinder 1 adjacent to the end portion 1E (FIGS. 33 and 34).

The rotation of the arm is effected around an axis ZZ (rod 241 born by a leg 242 of the support parallel to the axis C of the cylinder 1).

After placement of the protection arm 240 for protecting a portion of the cylinder adjacent to the portion 1E, a washing means such as a fabric is contacted with the portion 1E so as to remove the coating composition. Said removal is carried out when the coating composition is still wet or not dried or not cured with the cylinder still in rotation.

What I claim is:

1. Device for bearing and moving a swab intended to contact at least a part of an element so as to distribute a coating composition thereon and so as to achieve a substantially uniform coating thereof, said device comprising:

a support provided with a guiding path and with a means for bearing the element to be coated;

a mobile carriage comprising means for bearing the swab, said carriage being movable along the guiding path;

a means for ensuring a movement of the mobile carriage along the guiding path with respect to the element to be coated, whereby ensuring a relative movement of the swab with respect to the element to be coated, a conducting means adapted for conducting a coating composition on the support to be coated, said means having an open end adjacent to the swab, and a pushing means which is adapted for pushing the swab towards the element so that the swab acts as means for distributing the coating composition flowing out of the open end of the conducting means, whereby the open end of the means for conducting a coating composition is mounted on a carrier movable along a guiding path with respect to the element to be coated, said open end being adapted so that the composition flowing out from the open end contacts first the element to be coated before being distributed by the swab, and whereby the means for conducting the coating composition comprises a volumetric pump adapted for conducting to the open end the requested amount of coating composition so that after distribution of the coating composition on the element by the swab, a substantially uniform coating coats at least said part of the element.

2. The device of claim 1, further comprising a swab adapted for absorbing a portion of the coating composition flowing out of the open end of the conducting means.

3. The device of claim 1, in which the open end of the conducting means is placed with respect to the placement of the swab, so that when the swab contacts the element to be coated, the open end of the conducting means does not contact the element to be coated.

4. The device of claim 3, in which the open end of the conducting means is adapted for forming a drop of coating composition at said open end, and in which the open end of the conducting means is adjustable with respect to the element to be coated, so that when the swab contacts the element to be coated, the drop formed at said open end contacts the element to be coated.

5. The device of claim 1, in which the volumetric pump is connected to a flexible pipe having an inner diameter of less than 5 mm.

6. The device of claim 1, in which the volumetric pump is connected to a flexible pipe having an inner diameter of less than 2 mm.

7. The device of claim 1, in which the volumetric pump is connected to a flexible pipe having a an inner diameter of less than 1 mm.

8. The device of claim 1, in which the volumetric pump is connected to a flexible pipe having an inner diameter comprised between 0.100 mm and 1 mm.

9. The device of claim 1, which is provided with a container for the coating composition to be pumped by the volumetric pump, whereby said container is provided with a mixing means.

10. The device of claim 1, in which the carrier of the open end is the mobile carriage, the conducting means having a portion connected to the mobile carriage, whereby ensuring a movement of the open end with respect to the element to be coated, when the swab is moved with respect to the element to be coated.

11. The device of claim 1, in which the volumetric pump is a pump adapted for enabling a substantially flow of coating composition of less than 25 ml per minute.

12. The device of claim 1, in which the volumetric pump is a pump adapted for enabling a substantially flow of coating composition of less than 15 ml per minute.

13. The device of claim 1, in which the volumetric pump is a pump adapted for enabling a substantially flow of coating composition of less than 5 ml per minute.

14. The device of claim 1, in which the volumetric pump is a peristaltic pump.

15. The device of claim 1, in which the volumetric pump is a peristaltic pump, whereby said device comprises:

a flexible pipe with a inner diameter of less than 2 mm extending from a first open end up to a second open end, whereby the peristaltic pump is working on a portion of said flexible pipe, and a container for the coating composition to be pumped by the peristaltic pump, whereby said container is provided with a mixing means and with a guiding path for positioning at least the first open end of the flexible pipe.

16. The device of claim 15, in which the first open end of the flexible pipe is placed substantially at the level of the mixing means.

17. Device for bearing and moving a swab, the swab intended to contact at least a part of an element so as to distribute a coating composition thereon and so as to achieve a substantially uniform coating thereof, said device comprising:

a support provided with a guiding path and with a means for bearing the element to be coated;

a mobile carriage comprising means for bearing a swab, said carriage being movable along the guiding path;

a means for ensuring a movement of the mobile carriage along the guiding path with respect to the element to be coated, whereby ensuring a relative movement of the swab with respect to the element to be coated, a conducting means for conducting coating composition comprising at least a flexible pipe with an inner diameter of less than 2 mm extending from a first open end to a second open end, whereby the second open end of the flexible pipe is mounted on a carrier movable along a guiding path with respect to the element to be coated, the second end being adapted so that the composition flowing out from the open end contacts first the element to be coated before being distributed by the swab, and a pushing means which is adapted for pushing the swab towards the element to be coated so that the swab acts as means for distributing the coating composition flowing out of the open end of the conducting means, whereby the means for conducting the coating composition comprises:

a container for the coating composition, whereby said container is provided with a mixing means and with a guiding path for positioning at least the first open end of the flexible pipe, a peristaltic pump acting on a portion of the flexible pipe, said pump being adapted for conducting from the first open end of the flexible pipe to the second open end of the pipe the requested amount of coating composition so that after distribution of the coating composition on the element by the swab, a substantially uniform coating coats at least said part of the element.

18. The device of claim 17, further comprising a swab which is adapted for absorbing a portion of the coating composition flowing out of the second open end of the pipe.

19. The device of claim 17, in which the second open end of the pipe is placed with respect to the swab, so that when the swab contacts the element to be coated, the second open end of the pipe does not contact the element to be coated.

20. The device of claim 17, in which the second open end of the pipe is adapted for forming a drop of coating composition at said second open end, and in which the second open end of the pipe is adjustable with respect to the element to be coated, so that when the swab contacts the element to be coated, the drop formed at said second open end contacts the element to be coated.

21. The device of claim 17, in which the second open end of the pipe extends at least partly in a plane forming an angle comprised between 5 and 85° with respect to the axis of the pipe adjacent to said second open end.

22. The device of claim 17, in which the second open end of the pipe extends at least partly in a plane forming an angle comprised between 15 and 75° with respect to the axis of the pipe adjacent to said second open end.

23. The device of claim 17, in which the second open end of the pipe extends at least partly in a plane forming an angle comprised between 30 and 60° with respect to the axis of the pipe adjacent to said second open end.

24. The device of claim 17, which is provided with a system for adapting the position of the second open end of the pipe so that said second open end is located at less than 10 mm from the swab.

25. The device of claim 17, which is provided with a container for the coating composition to be pumped by the peristaltic pump, whereby said container is provided with a mixing means.

26. The device of claim 17, in which the carrier of the second open end is the mobile carriage, the conducting means having a portion connected to the mobile carriage, whereby ensuring a movement of the second open end with respect to the element to be coated, when the swab is moved with respect to the element to be coated.

27. The device of claim 17, which comprises:

a flexible pipe with a inner diameter of less than 2 mm extending from a first open end up to a second open end, whereby the peristaltic pump is working on a portion of said flexible pipe, a container for the coating composition to be pumped by the peristaltic pump, whereby said container is provided with a mixing means and with a guiding path for positioning at least the first open end of the flexible pipe.

28. The device of claim 17, said device further comprising a room in which at least the support and the mobile carriage are located, said room being provided with an inlet connected to an air cleaning system.

29. The device of claim 28, in which the said inlet is adapted for ensuring a substantially laminar flow at least in the neighborhood of the support and the mobile carriage.

30. The device of claim 17, said device further comprising a table, a vertical supporting element, and fixing means, whereby the support is movable between a first position in which the support is fixed to the table and a second position in which the support is fixed on the vertical supporting element.

31. The device of claim 17, which further comprises a driving means for driving into rotation the element to be coated.

32. The device of claim 17, which further comprises a means for varying the pushing of the swab towards at least a part of the element to be coated during the movement of the carriage corresponding to the coating of the said part of the element by the swab, the said pushing varying substantially continuously from a first pushing force and a second pushing force so that the coating of the said part is substantially uniform.

33. The device of claim 17, in which the mobile carriage has a body movable along the guiding path, said body being provided with a pivoting piece bearing the swab.

34. The device of claim 33, in which the pivoting piece is mounted pivotable with respect to the body around an axis parallel to the guiding path of the carriage.

35. The device of claim 17, in which the means for ensuring a movement of the mobile carriage along the guiding path with respect to the element to be coated moves the said mobile carriage according to a back-and-forth motion.

36. The device of claim 17, in which the means for ensuring a movement of the mobile carriage along the guiding path with respect to the element to be coated moves the said mobile carriage according to a back-and-forth motion, wherein at least during a part of the forth motion, the swab contacts the element to be coated, said device further comprising a means for moving the swab and the element to be coated aside during the back motion of the carriage.

37. The device of claim 17, which further comprises a means for moving the swab and the element aside after the coating of the element.

38. The device of claim 17, which further comprises a means for holding the swab and the element aside when the carriage is adjacent to a first position of the guiding path, and a means for displacing at least a part of the carriage when the carriage is moved away from the said first position, so that the swab contacts the element.

39. The device of claim 17, in which the means for bearing the element to be coated comprises two bearing elements between which the element to be coated is placed, said bearing elements being aligned along a first axis, and in which the mobile carriage is movable along an axis parallel to the guiding path of the carriage, said axis being distant from the said first axis and being not parallel to the said first axis.

40. The device of claim 39, in which the first axis is an axis of rotation of the element to be coated.

41. The device of claim 17, in which the means for bearing the element to be coated comprises two bearing elements between which the element to be coated is placed, said bearing elements being aligned along a first axis, and in which the mobile carriage is movable along a second axis parallel to the guiding path of the carriage, said second axis forming an angle with a line parallel to the said first axis and crossing the said second axis.

42. The device of claim 41, in which the angle is comprised between 0.1° and 15°.

43. The device of claim 17, which comprises a means for adapting the pushing force of the swab on the element to be coated after placement of a swab on the mobile carriage.

44. The device of claim 17, which comprises a means for adapting the pushing force of the swab on the element to be coated after placement of an element to be coated on the support.

45. The device of claim 17, which comprises a protection element movable with respect to the support between a position enabling the coating of the element to be coated and a position protecting at least a first portion of the element after its coating.

46. The device of claim 45, which comprises an absorbing element movable with respect to the support between a position aside the element to be coated and a position in which the absorbing element contacts a second portion of the element adjacent to the first portion of the element protected by the protection element.

47. Device for bearing and moving a swab intended to contact at least a part of an element so as to distribute a coating composition thereon and so as to achieve a substantially uniform coating thereof coating at least a part of the element, in which a coating composition contacts the element to be coated, said device comprising:

a support provided with a guiding path and with a means for bearing the element to be coated;

a mobile carriage comprising means for bearing the swab, said carriage being movable along the guiding path;

a means for ensuring a movement of the mobile carriage along the guiding path with respect to the element to be coated, whereby ensuring a relative movement of the swab with respect to the element to be coated, a protection element movable with respect to the support between a position enabling the coating of the element to be coated and a position protecting at least a first portion of the element after its coating.

48. The device of claim 47, which comprises an absorbing element movable with respect to the support between a position aside the element to be coated and a position in which the absorbing element contacts a second portion of the element adjacent to the first portion of the element protected by the protection element.

* * * * *